US005858929A

United States Patent [19]

Sumiejski et al.

[11] Patent Number: 5,858,929

[45] Date of Patent: Jan. 12, 1999

[54] COMPOSITION FOR PROVIDING ANTI-SHUDDER FRICTION DURABILITY PERFORMANCE FOR AUTOMATIC TRANSMISSIONS

[75] Inventors: James L. Sumiejski, Mentor; William C. Ward, Painesville, both of Ohio; Mitsuo Higashi, Achi Prefecture, Japan; Craig D. Tipton, Perry, Ohio

[73] Assignee: The Lubrizol Corporation, Wickliffe, Ohio

[21] Appl. No.: 575,271

[22] Filed: Dec. 21, 1995

Related U.S. Application Data

[63] Continuation-in-part of Ser. No. 489,187, Jun. 9, 1995, abandoned.

[51] Int. Cl.[6] ..... C10M 141/10

[52] U.S. Cl. ..... 508/162; 508/164; 508/185; 508/199; 252/74; 252/75

[58] Field of Search ..... 508/162, 164, 508/185, 199; 252/74, 75

[56] References Cited

U.S. PATENT DOCUMENTS

| | | | |
|---|---|---|---|
| 3,029,250 | 4/1962 | Gaertner | 260/326.5 |
| 3,232,883 | 2/1966 | LeSuer et al. | 252/32.5 |
| 3,275,554 | 9/1966 | Wagenaar | 252/50 |
| 3,367,864 | 2/1968 | Elliott et al. | 252/32.7 |
| 3,438,757 | 4/1969 | Honnen et al. | 44/58 |
| 3,480,548 | 11/1969 | Hellmuth et al. | 252/33.4 |
| 3,489,682 | 1/1970 | LeSuer | 252/75 |
| 3,595,791 | 7/1971 | Cohen | 252/33.6 |
| 3,926,822 | 12/1975 | Habiby | 252/48.6 |
| 3,929,650 | 12/1975 | Itoh et al. | 60/39.28 |
| 3,944,495 | 3/1976 | Wiley et al. | 252/75 |
| 3,953,347 | 4/1976 | Habiby | 252/48.6 |
| 3,957,664 | 5/1976 | Heilmann et al. | 252/59 |
| 4,029,587 | 6/1977 | Koch | 252/48.2 |
| 4,031,023 | 6/1977 | Musser et al. | 252/48.2 |
| 4,119,549 | 10/1978 | Davis | 252/45 |
| 4,119,550 | 10/1978 | Davis et al. | 252/45 |
| 4,172,855 | 10/1979 | Shubkin et al. | 585/16 |
| 4,191,659 | 3/1980 | Davis | 252/45 |
| 4,280,916 | 7/1981 | Richards et al. | 252/33.4 |
| 4,344,854 | 8/1982 | Davis et al. | 252/45 |
| 4,466,894 | 8/1984 | Grover | 252/32.7 |
| 4,525,289 | 6/1985 | Howie et al. | 252/49.9 |
| 4,529,528 | 7/1985 | Horodysky | 252/49.6 |
| 4,584,115 | 4/1986 | Davis | 252/49.6 |
| 4,594,378 | 6/1986 | Tipton et al. | 524/106 |
| 4,622,158 | 11/1986 | Walsh | 252/49.3 |
| 4,741,848 | 5/1988 | Koch et al. | 252/49.6 |
| 4,752,416 | 6/1988 | Scharf et al. | 252/78.5 |
| 4,792,410 | 12/1988 | Schwind et al. | 252/38 |
| 4,957,651 | 9/1990 | Schwind | 252/56 |
| 5,062,975 | 11/1991 | Bayles, Jr. et al. | 252/75 |
| 5,078,893 | 1/1992 | Ryer et al. | 508/195 |
| 5,202,036 | 4/1993 | Ripple et al. | 252/33.4 |
| 5,284,591 | 2/1994 | Bayles, Jr. et al. | 252/75 |
| 5,344,579 | 9/1994 | Ohtani et al. | 252/51.5 |
| 5,403,501 | 4/1995 | Schwind | 252/32.7 |

FOREIGN PATENT DOCUMENTS

| | | | |
|---|---|---|---|
| 1188704 | 6/1985 | Canada . | |
| 0578435 | 1/1994 | European Pat. Off. | C10M 169/04 |
| 0622444 | 11/1994 | European Pat. Off. | C10M 125/24 |
| 0646639 | 4/1995 | European Pat. Off. | C10M 141/10 |

OTHER PUBLICATIONS

Dextron®–III—Automatic Transmission fluid Specification, GM–6297M, Apr., 1993, Materials Engineering Transmission, M/C 748, Ypsilanti, MI 48197.

SAE Technical Paper Series No. 941883, Friction and Stick–Slip Durability Testing of ATF by Ward et al, presented at SAE International Fuels and Lubricants Meeting and Exposition, Baltimore, Maryland, Oct. 17–20, 1994.

*Primary Examiner*—Jerry D. Johnson
*Attorney, Agent, or Firm*—David M. Shold

[57] ABSTRACT

A composition for use in lubricants and function fluids to provide improved anti-shudder and shudder durability properties to an automatic transmission. The composition comprises alkoxylated fatty amines as well as a mixture of other friction modifiers.

5 Claims, No Drawings

COMPOSITION FOR PROVIDING ANTI-SHUDDER FRICTION DURABILITY PERFORMANCE FOR AUTOMATIC TRANSMISSIONS

This is a continuation-in-part of co-pending application 08/489,187 filed Jun. 9, 1995, now abandoned.

BACKGROUND OF THE INVENTION

Field of the Invention

This invention encompasses compositions for providing lubricants and functional fluids with improved frictional properties. Vibrations (shudder or stick slip) in automatic transmissions (AT) caused by continuous slip torque converter clutches and shifting clutches are greatly reduced or eliminated by the use of the fluids of this invention in said transmissions.

Automatic transmission fluids (ATF) are well known in the art. In general however, automatic transmission suppliers and manufacturers specify performance characteristics of the transmission operating with a fluid rather than fluid composition for use in the transmission. It is then up to fluid providers to formulate fluids which meet performance characteristics. Recently, performance requirements for ATFs Service Fills have become more stringent with publication of DEXTRON-III ATF Specification by General Motors, GM 6297M, April, 1993. The Specification is available from General Motors, Material Engineering Transmissions, M/C 748 Ypsilanti, Mich 48197 and is herein incorporated by reference.

Low frequency vibration in continuous slip torque converter clutches (CSTCC) has been defined as shudder. The shudder vibration is related to stick slip friction characteristics of the engaged CSTCC rotating at slow speeds. Further, shudder has two components, initial shudder and shudder durability. The latter is shudder which develops over time. Compositions of the present invention were tested for anti-shudder properties when compared to commercial ATF formulations both for initial shudder and shudder durability. It was found that compositions of this invention eliminated or greatly reduced shudder and shudder durability problems whereas no commercial ATF available performed as well.

Compositions of the instant invention and commercial ATF's were tested in a Chrysler® minivan with a 41TE transmission. The compositions of the instant invention were by far superior to commercial ATF's in anti-shudder and anti-shudder durability tests. Detailed descriptions of anti-shudder testing procedures are given in SAE TECHNICAL PAPER SERIES NO. 941883, Friction and Stick-Slip Durability Testing of ATF by Ward et al, presented at SAE International Fuels and Lubricants Meeting and Exposition, Baltimore, Md., Oct. 17–20, 1994. This publication is available from SAE International, 400 Commonwealth Drive, Warrendale, Pa. 15096-0001 U.S.A.

In general, automatic transmission fluids comprise a base oil and additives. The base oil may be from natural sources; mineral and plant oils, and from synthetics and will be of the proper viscosity for their intended use. Additives are then incorporated into the base oil with those incorporated being dependent upon the properties that the fluid formulator is striving for. Additives generally can be roughly broken into two groups, chemically inert and chemically active additives as listed below:

| Chemically Active Additives | Chemically Inactive Additives |
|---|---|
| anti-oxidants | viscosity improvers |
| corrosion inhibitors | friction modifiers |
| rust inhibitors | defoamers |
| anti-wear agents | pour point depressants |
| dispersants | |
| detergents | |
| seal swell agents | |

Formulations for ATF's and functional fluids containing some or all of the above additives in a select base oil are freely available in the patent literature. For instance, U.S. Pat. No. 4,209,587 to Koch lists lubricating/functional fluid compositions with various combinations of base oils and additives. U.S. Pat. No. 5,344,579 to Ohtani and Harley describes a friction modifier system for AT and cites additive components for ATF's and their typical ranges. The disclosure of both U.S. patents cited above are herein incorporated by reference. It must be noted that the lines between chemically active and inactive additives are not so distinct. Also, additives may well be multifunctional and are categorized above only for the sake of convenience.

SUMMARY OF THE INVENTION

Despite the voluminous information and formulations available for ATF's, none has been found which match the anti-shudder and shudder durability test results demonstrated by the invention described herein.

This invention comprises a friction modifier additive package which when incorporated into ATF's provide an AT filled with said ATF with improved anti-shudder and shudder durability performance. The additive package comprises:

A. an overbased alkali or alkaline earth metal salt component selected from the group consisting of sulfonates, phenates, salicylates, carboxylates and mixtures thereof;

B. friction modifiers; said friction modifiers comprising an alkoxylated fatty amine and two friction modifier selected from the group consisting of:
fatty phosphites
fatty epoxides
borated fatty epoxides
fatty amines
borated alkoxylated fatty amines
fatty acid amides
fatty acid metal salts
glycerol esters
borated glycerol esters
fatty imidazolines.

A key feature of the additive package of the instant invention is the selection of alkoxylated fatty amines as a component of the friction modifier and the use of non-borated overbased metal salts. These features distinguish this invention from U.S. Pat. No. 4,792,410 which is herein incorporated by reference.

DETAILED DESCRIPTION OF THE INVENTION

The ATF's formulated with the additive package are particularly effective against shudder when used in AT's with continuous slip torque converter clutches.

The additive package composition comprises mixtures of several friction modifiers, and an overbased alkali metal or alkaline earth metal salt selected from the group consisting of sulfonates, phenols, salicylates, carboxylates and mixtures thereof which when dissolved in an oil of lubricating viscosity provides an ATF with greatly improved shudder and shudder durability properties.

The first component of the package composition is the overbased metal salts of organic acids which have been found useful in assisting the frictional properties of ATF's. Borated and non-borated overbased materials are described in U.S. Pat. Nos. 5,403,501 and 4,792,410 which are herein incorporated by reference for disclosure pertinent hereto.

Preferred overbased organic salts are the sulfonate salts having a substantially oleophilic character and which are formed from organic materials. Organic sulfonates are well known materials in the lubricant and detergent arts. The sulfonate compound should contain on average from about 10 to about 40 carbon atoms, preferably from about 12 to about 36 carbon atoms and preferably from about 14 to about 32 carbon atoms on average. Similarly, the phenates, oxylates and carboxylates have a substantially oleophilic character.

While the present invention allows for the carbon atoms to be either aromatic or in paraffinic configuration, it is highly preferred that alkylated aromatics be employed. While naphthalene based materials may be employed, the aromatic of choice is the benzene moiety.

The most preferred composition is thus an overbased monosulfonated alkylated benzene, and is preferably the monoalkylated benzene. Typically, alkyl benzene fractions are obtained from still bottom sources and are mono- or di-alkylated. It is believed, in the present invention, that the mono-alkylated aromatics are superior to the dialkylated aromatics in overall properties.

It is desired that a mixture of mono-alkylated aromatics (benzene) be utilized to obtain the mono-alkylated salt (benzene sulfonate) in the present invention. The mixtures wherein a substantial portion of the composition contains polymers of propylene as the source of the alkyl groups assists in the solubility of the salt. The use of mono-functional (e.g., mono-sulfonated) materials avoids crosslinking of the molecules with less precipitation of the salt from the lubricant.

It is preferred that the salt be "overbased". By overbasing, it is meant that a stoichiometric excess of the metal be present over that required to neutralize the anion of the salt. The excess metal from overbasing has the effect of neutralizing acids which may build up in the lubricant. A second advantage is that the overbased salt increases the dynamic coefficient of friction. Typically, the excess metal will be present over that which is required to neutralize the anion at about 10:1 to 30:1, preferably 11:1 to 18:1 on an equivalent basis.

The amount of the overbased salt utilized in the additive package is typically from about 5% to about 30%, preferably from about 5% to about 25%, and most preferably from about 10% to about 25% by weight of the total composition. The weight percents are on an oil free basis. The overbased salt is usually made up in about 50% oil with a TBN range of 10–600.

A. Overbased Metal Salt of an Organic Acid

Organic Acids—The organic acids useful in making the overbased compositions of the present invention include carboxylic acid, sulfuric acid, phosphorus-containing acid, phenol or mixtures of two or more thereof.

Carboxylic Acids—The carboxylic acids useful in making the salts of the invention may be aliphatic or aromatic, mono- or polycarboxylic acid or acid producing compounds. These carboxylic acids include lower molecular weight carboxylic acids (e.g., carboxylic acids having up to about 22 carbon atoms such as acids having about 4 to about 22 carbon atoms or tetrapropenyl-substituted succinic anhydride) as well as higher molecular weight carboxylic acids. Throughout the specification and in the appended claims, any reference to carboxylic acids is intended to include the acid-producing derivatives thereof such as anhydrides, lower alkyl esters-, acyl halides, lactones and mixtures thereof unless otherwise specifically stated.

The carboxylic acids of this invention are preferably oil-soluble and the number of carbon atoms present in the acid is important in contributing to the desired solubility of the borated salts (B). Usually, in order to provide the desired oil-solubility, the number of carbon atoms in the carboxylic acid should be at least about 8, more preferably at least about 18, more preferably at least about 30, more preferably at least about 50. Generally, these carboxylic acids do not contain more than about 400 carbon atoms per molecule.

The lower molecular weight monocarboxylic acids contemplated for use in this invention include saturated and unsaturated acids. Examples of such useful acids include dodecanoic acid, decanoic acid, oleic acid, steric acid, linoleic acid, tall oil acid, etc. Mixtures of two or more such agents can also be used. an extensive discussion of these acids is found in Kirk-Othmer "Encyclopedia of Chemical Technology" Third Edition, 1978, John Wiley & Sons New York, pp. 814–871; these pages being incorporated herein by reference.

Examples of lower molecular weight polycarboxylic acids include dicarboxylic acids and derivatives such as sebacic acid, cetyl malonic acid, tetrapropylene-substituted succinic anhydride, etc. Lower alkyl esters of these acids can also be used.

The monocarboxylic acids include is aliphatic acids. Such acids often contain a principal chain having from about 14 to about 20 saturated, aliphatic carbon atoms and at least one but usually no more than about four pendant acyclic lower alkyl groups. Specific examples of such isoaliphatic acids include 10-methyltetradecanoic acid, 3-ethyl-hexadecanoic acid, and 8-methyl octadecanoic acid.

The isoaliphatic acids include mixtures of branch-chain acids prepared by the isomerization of commercial fatty acids (oleic, linoleic or tall oil acids) of, for example, about 16 to about 20 carbon atoms.

The higher molecular weight mono- and polycarboxylic acids suitable for use in making the salts are well known in the art and have been described in detail, for example, in the following U.S., British and Canadian patents. U.S. Pat. Nos. 3,024,237; 3,172,892; 3,219,666; 3,245,910; 3,271,310; 3,277,746; 3,278,550; 3,306,907; 3,312,619; 3,341,542; 3,367,943; 3,374,174; 3,381,022; 3,454,607; 3,470,098; 3,630,902; 3,755,169; 3,912,764; and 4,368,133. British Patents 944,136; 1,085,903; 1,162,436; and 1,440,219. Canadian Patent 956,397. These patents are incorporated herein by reference for their disclosure of higher molecular weight mono- and polycarboxylic acids and methods for making the same.

A group of useful aromatic carboxylic acids are those of the formula:

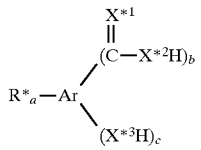

(XIII)

wherein Formula XIII, R* is an aliphatic hydrocarbyl group of preferably about 4 to about 400 carbon atoms, a is a number in the range of zero to about 4, Ar is an aromatic group, $X^{*1}$, $X^{*2}$ and $X^{*3}$ are independently sulfur or oxygen, b is a number in the range of from 1 to about 4, c is a number in the range of 1 to about 4, usually 1 to 2, with the proviso that the sum of a, b and c does not exceed the number of valences of Ar. Preferably, R* and a are such that there is an average of at least about 8 aliphatic carbon atoms provided by the R* in each compound represented by Formula IXXX.

The aromatic group Ar in Formula XIII may have the same structure as any of the aromatic groups Ar discussed below under the heading "Phenols". Examples of the aromatic groups that are useful herein include the polyvalent aromatic groups derived from benzene, naphthalene, anthracene, etc., preferably benzene. specific examples of Ar groups include phenylenes and naphthylene, e.g., methylphenylenes, ethoxyphenylenes, isopropylphenylenes, hyroxyphenylenes, dipropoxynaphthylenes, etc.

Examples of the R* groups in Formula XIII include butyl, isobutyl, pentyl, octyl, nonyl, dodecyl, and substituents derived from polymerized olefins such as polyethylenes, polypropylenes, polyisobutylenes, ethylenepropylene copolymers, oxidized ethylene-propylene copolymers, and the like.

Within this group of aromatic acids, a useful class of carboxylic acids are those of the formula

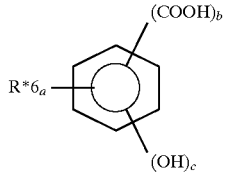

(XIV)

wherein in Formula XIV, $R^{+6}$ is an aliphatic hydrocarbyl group preferably containing from about 4 to about 400 carbon atoms, a is a number in the range of from zero to about 4, preferably 1 to about 3; b is a number in the range of 1 to about 4, preferably 1 to about 2, c is a number in the range of 1 to about 4, preferably 1 to about 2, and more preferably 1; with the proviso that the sum of a, b and c does not exceed 6. Preferably, $R^{+6}$ and a are such that the acid molecules contain at least an average of about 12 aliphatic carbon atoms in the aliphatic hydrocarbon substituents per acid molecule.

Also useful are the aliphatic hydrocarbon-substituted salicyclic acids wherein each aliphatic hydrocarbon substituent contains an average of at least about 8 carbon atoms per substituent and 1 to 3 substituents per molecule. Salts prepared from such salicyclic acids wherein the aliphatic hydrocarbon substituents are derived from polymerized olefins, particularly polymerized lower 1-mono-olefins such as polyethylene, polypropylene, polyisobutylene, ethylene/propylene copolymers and the like and having average carbon contents of about 30 to about 400 carbon atoms are particularly useful.

The aromatic carboxylic acids corresponding to Formulae XIII and XIV above are well known or can be prepared according to procedures known in the art. Carboxylic acids of the type illustrated by these formulae and processes for preparing their neutral and basic metal salts are well known and disclosed, for example, in U.S. Pat. Nos. 2,197,832; 2,197,835; 2,252,662; 2,252,664; 2,714,092; 3,410,798 and 3,595,791.

Sulfonic acids—The sulfonic acids useful in making salts (B) of the invention include the sulfonic and thiosulfonic acids. Generally they are salts of sulfonic acids.

The sulfonic acids include the mono- or polynuclear aromatic or cycloaliphatic compounds. The oil soluble sulfonates can be represented for the most part by the following formulae:

$$R^{\#1}{}_a—T—(SO_3)_b \quad (XV)$$

$$R^{\#2}—(SO_3)_a \quad (XV)$$

In the above Formulae XV and XVI, T is a cyclic nucleus such as, for example, benzene, naphthalene, anthracene, diphenylene oxide, diphenylene sulfide, petroleum naphthenes, etc.; $R^{\#1}$ is an aliphatic group such as alkyl, alkenyl, alkoxy, alkoxyalkyl, etc.; a is at least 1, and $R^{\#1}{}_a$ +T contains a total of at least about 15 carbon atoms. $R^{\#2}$ is an aliphatic hydrocarbyl group containing at least about 15 carbon atoms. Examples of $R^{\#2}$ are alkyl, alkenyl, alkoxyalkyl, carboalkoxyalkyl, etc. Specific examples of $R^{\#2}$ are groups derived from petrolatum, saturated and unsaturated paraffin wax, and polyolefins, including polymerized $C_2$ $C_3$, $C_4$, $C_5$, $C_6$, etc., olefins containing from about 15 to 7000 or more carbon atoms. The groups T, $R^{\#1}$ and $R^{\#2}$ in the above Formula XV, a and b are at least 1, and likewise in Formula XVI, a is at least 1.

Specific examples of oil-soluble sulfonic acids are mahogany sulfonic acids; bright stock sulfonic acids; sulfonic acids derived from lubricating oil fractions having a Saybolt viscosity from about 100 seconds at 100° F. to about 200 seconds at 210° F.; petrolatum sulfonic acids; mono- and poly-wax substituted sulfonic and polysulfonic acids of, e.g., benzene, naphthalene, phenol, diphenyl ether, naphthalene disulfide, etc.; other substituted sulfonic acids such as alkyl benzene sulfonic acids (where the alkyl group has at least 8 carbons), cetylphenol mono-sulfide sulfonic acids, dilauryl beta naphthyl sulfonic acids, and alkaryl sulfonic acids such as dodecyl benzene "bottoms" sulfonic acids.

Dodecyl benzene "bottoms" sulfonic acids are the material leftover after the removal of dodecyl benzene sulfonic acids that are used for household detergents. These materials are generally alkylated with higher oligomers. The bottoms may be straight-chain or branched-chain alkylates with a straight-chain dialkylate preferred.

The production of sulfonates from detergent manufactured by-products by reaction with, e.g., S03, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

Also included are aliphatic sulfonic acids such as paraffin wax sulfonic acids, unsaturated paraffin wax sulfonic acids, hydroxy-substituted paraffin was sulfonic acids, hexapropylene sulfonic acids, tetra-amylene sulfonic acids, polyisobutene sulfonic acids wherein the polyisobutene contains from 20 to 7000 or more carbon atoms, chloro-substituted paraffin wax sulfonic acids, etc., cycloalpiphatic sulfonic acids such as petroleum naphthlene sulfonic acids, lauryl cyclohexyl sulfonic acids, mono- or poly-wax-substituted cyclohexyl sulfonic acids, etc.

With respect to the sulfonic acids or salts thereof described herein and in the appended claims, it is intended herein to employ the term "petroleum sulfonic acids" or "petroleum sulfonates" to cover all sulfonic acids or the salts thereof derived from petroleum products. A useful group of petroleum sulfonic acids are the mahogany sulfonic acids (so called because of their reddish-brown color) obtained as a by-product from the manufacture of petroleum white oils by a sulfuric acid process.

Generally neutral and basic salts of the above-described synthetic and petroleum sulfonic acids are useful in the practice of this invention.

Phosphorus-Containing Acids—The phosphorus-containing acid may be any of the acids described below under Component D-1 or Component D-3.

In a preferred embodiment, the phosphorus-containing acid is the reaction product of an olefin polymer and phosphorus sulfide. The olefin polymers generally have a molecular weight of at least 150 up to about 48,000, preferably from about 500 to about 5000. The polymers include homopolymers and interpolymers of monolefins having from 2 to about 12 carbon atoms. Examples of useful monolefins include ethylene, propylene, butylene, hexylene, etc.

Useful phosphorus sulfide-containing sources include phosphorus pentasulfide, phosphorus esquisulfide, phosphorus heptasulfide and the like.

The reaction of the olefin polymer and the phosphorus sulfide generally may occur by simply mixing the two at a temperature above 80° C., preferably between 100° C. and 300° C. Generally, the products have a phosphorus content from about 0.05% to about 10%, preferably from about 0.1% to about 5%. The relative proportions of the phosphorizing agent to the olefin polymer is generally from 0.1 part to 50 parts of the phosphorizing agent per 100 parts of the olefin polymer.

The phosphorus-containing acids useful in the present invention are described in U.S. Pat. No. 3,232,883 issued to Le Suer. This reference is herein incorporated by reference for its disclosure to the phosphorus-containing acids and methods for preparing the same.

Phenols—The phenols useful in making the borated salts of the invention can be represented by the formula:

$$R^{\#3}{}_a\text{—}Ar(OO)_b \qquad \text{(XVIII)}$$

wherein in Formula XVIII, $R^{\#3}$ is a hydrocarbyl group of from about 4 to about 400 carbon atoms; Ar is an aromatic group; a and b are independently numbers of at least one, the sum of a and b being in the range of two up to the number of displaceable hydrogens on the aromatic nucleus or nuclei of Ar. Preferably, a and b are independently numbers in the range of 1 to about 4, more preferably 1 to about 2. $R^{\#3}$ and a are preferably such that there is an average of at least about 8 aliphatic carbon atoms provided by the $R^{\#3}$ groups for each phenol compound represented by Formula IVIII.

While the term "phenol" is used herein, it is to be understood that this term is not intended to limit the aromatic group of the phenol to benzene. Accordingly, it is to be understood that the aromatic group as represented by "Ar" in Formula XII, as well as elsewhere in other formulae in this specification and in the appended claims, can be mononuclear such as a phenyl, a pyridyl, or a thienyl, or polynuclear. The polynuclear groups can be of the fused type wherein an aromatic nucleus is fused at two points to another nucleus such as found in naphthyl, anthranyl, etc. The polynuclear group can also be of the linked type wherein at least two nuclei (either mononuclear or polynuclear) are linked through bridging linkages to each other. These bridging linkages can be chosen from the group consisting of alkylene linkages, ether linkages, keto linkages, sulfide linkages, polysulfide linkages of 2 to about 6 sulfur atoms, etc.

The number of aromatic nuclei, fused, linked or both, in Ar can play a role in determining the integer values of a and b in formula XVIII. For example, when Ar contains a single aromatic nucleus, the sum of a and be is from 2 to 6. When Ar contains two aromatic nuclei, the sum of a and b is from 2 to 10. With a tri-nuclear Ar moiety, the sum of a and b is from 2 to 51. The value for the sum of a and b is limited by the fact that it cannot exceed the total number of displaceable hydrogens on the aromatic nucleus or nuclei of Ar.

The $R^{\#3}$ group in Formula XVIII is a hydrocarbyl group that is directly bonded to the aromatic group Ar. $R^{\#3}$ preferably contains about 6 to about 80 carbon atoms, preferably about 6 to about 30 carbon atoms, more preferably about 8 to about 25 carbon atoms, and advantageously about 8 to about 15 carbon atoms. Examples of $R^{\#3}$ groups include butyl, isobutyl, pentyl, octyl, nonyl, dodecyl, 5-chlorohexyl, 4-ethoxypentyl, 3-cyclohexyloctyl, 2,3,5 trimethylheptyl, and substituents derived from polymerized olefins such as polyethylenes, polypropylenes, polyisobutylenes, ethylene-propylene copolymers, chlorinated olefin polymers, oxidized ethylene-propylene copolymers, propylene tetramer and tri(isobutene).

The overbasing is generally done such that the metal ratio is from about 1.05:1 to about 50:1, preferably 2:1 to about 30:1 and most preferably from about 4:1 to about 25:1. The metal ratio is that ratio of metallic ions on an equivalent basis to the anionic portion of the overbased material. This degree of overbasing is reported as the Total Base Number (TBN). The preferred TBN of the detergent is in the range of 25–200 as determined by ASTM method 2896D. However, TBN ranges of 10–600 may be used.

2. The Inert Liquid Medium. The inert liquid medium when utilized to obtain the borated product facilitates mixing of the ingredients. That is, the overbased material tend to be rather viscous especially when the alkaline earth metal components are utilized. Thus, the inert liquid medium serves to disperse the product and to facilitate mixing of the ingredients. The inert liquid medium is typically a material which boils at a temperature much greater than that of water and which is useful in the end product for which the invention is intended.

Typically, the inert liquid medium is a member selected from the group consisting of aromatics, aliphatics, alkanols and mineral oil and mixture thereof. The aromatics utilized are typically benzene or toluene while the aliphatics are materials having from about 6 to about 600 carbon atoms. The alkanols may be mono- or di-alkanols and are preferably those materials which have limited water solubility. Typically, alkanols containing 10 or less carbon atoms are useful herein. Mineral oil, when used as the inert liquid medium is as typically defined by the ASTM standards.

The inert liquid medium may be omitted where, for example, the product is extruded. In such cases mechanical mixing replaces the need for a solvent.

3. The Carbon Dioxide Component. The carbon dioxide content of product (d) is typically greater than about 5% by weight. It is desirable that the carbon dioxide content of product (d) be between 5.5% and about 12% by weight. The weights given herein are by weight of the total product including the inert medium. The carbon dioxide content of the products is obtained by acidifying the product to liberate all of the $CO_2$ in the product. For purposes herein, the terms carbon dioxide and carbonate are identical. That is, the carbonate is the chemically incorporated form of the carbon dioxide and the latter is the compound used to specify the amount of carbonate in the product. Thus, the ratios expressed herein use the molecular weight (44) of carbon dioxide.

4. The boronating agent. This is typically orthoboric acid. Also useful herein are boron acid, boron anhydride, boron esters, and similar materials. The boron content of the products of the present invention is typically greater than 3%, preferably greater than 4% and most preferably greater than 5% by weight of the product. It is also desirable that the weight percent of carbon dioxide in the product (d) is at least 50% by weight of the boron in product (d). Preferably, the present carbon dioxide to the percent boron is greater than 75% and most preferably greater than 100% by weight of the boron.

5. The water content of the product when it is finished is typically less than 3% by weight. At levels much greater than 2% by weight substantial amounts of the boron can be lost by forming boron compounds which are soluble in the water and which are separated off. If the separation does not occur during processing, then during storage, the boron content may be diminished by having unacceptably high levels of water in the product. More preferably, the water content of the product is less than 1% by weight and most preferably less than 0.75% by weight.

6. The Processing. The products herein are conventionally obtained up to the point where the boron incorporation occurs. That is, the boronation aspect to obtain the alkali metal or alkaline earth metal overbased sulfonate is downstream from the carbonation facility. If desired, carbonation may continue; however, such is not necessary and hinders the boronation in addition to raising the cost of the product.

The mixture of overbased acid as defined above is treated at a temperature less than that at which substantial foaming occurs. Such temperature is typically less than 110° C., more preferably less than 99° C., and most preferably between about 66° C. and about 88° C. It is also desirable that the temperature is raised during the boronation but not raised so rapidly as to cause substantial foaming. not only does the foaming cause a loss of head space in the reaction vessel with a concomitant blocking of reaction ports but the product is not believed to be the same if it is rapidly liberated of carbon dioxide. That is, there is an exchange reaction occurring between the carbon dioxide portion of the overbased material and the boronating agent wherein boron polymers are incorporated into the overbased material. Thus, the boronation is allowed to occur without substantial foaming until the point where substantially no more boron is taken up by the overbased material.

At the point where the boron is substantially chemically incorporated within the overbased material, the temperature is then raised to a point in excess of the boiling point of water within the mixture. Such temperatures are typically in excess of 100° C. as the water tends to separate rapidly from the reaction mass at that temperature. conveniently, the temperature for removing the water is between about 120° C. and 180° C. As the boronation is substantially complete and the carbon dioxide content of the product is stable, substantial foaming is avoided at the point where the water is taken from the product. thus, little carbon dioxide will be liberated between steps.

The product is typically recovered as the high carbonate content borated product by allowing the product to cool, followed by suitable packaging. Of course, the product is slightly hygroscopic due to the high inorganic content and, thus, protective packaging is recommended. The product may also be recovered by transferring it for downstream processing such as mixing it with additional materials such as an oil of lubricating viscosity or other desired components for a lubricant or a grease. A significant advantage is practicing the present invention is that the boronation is brought about without alternatively raising and lowering the temperature, especially during segmental addition of the boronating agent.

It is desired that the mean particle diameter of the products obtained herein is less than 9 microns, preferably less than 8 microns and most preferably less than 5 microns. Preferably, the particle size distribution is such that substantially all of the particles are less than 9 microns, more preferably less than 8 microns and most preferably less than 5 microns. Thus, the products obtained herein are substantially different than those known in the art in that the fine particle size obtained herein allows effective dispersion in an oil or grease thereby giving effective protection for the metal surfaces with which the product is brought into contact. General guidance in determining the particle size herein is found in the Textbook of Polymer Science by Billmeyer, fourth printing, March, 1966, Library of Congress Catalog No. 62.18350.

B. Friction Modifiers. The second component of the package is the friction modifier. The friction modifier comprises an alkoxylated fatty amine and at least two other friction modifiers selected from the group consisting fatty phosphites, fatty epoxides, borated fatty epoxides, fatty amines, borated alkoxylated fatty amines, fatty acid amides, glycerol esters, borated glycerol esters, fatty imidazolines or mixtures thereof.

1. The phosphites are generally of the formula $(RO)_2PHO$. The preferred dialkylated phosphite as shown in the preceding formula is typically present with a minor amount of monoalkylated phosphite of the formula (RO)(HO)PHO.

In the above structure of the phosphite, the term "R" has been referred to as an alkyl group. It is, of course, possible that the alkyl is alkenyl and thus the terms "alkyl" and "alkylated", as used herein, embrace other than saturated alkyl groups within the phosphite. The phosphite utilized herein is one having sufficient hydrocarbyl groups to render the phosphite substantially oleophilic and further that the hydrocarbyl groups are preferably substantially unbranched.

Many suitable phosphites are available commercially and may be synthesized according to U.S. Pat. No. 4,752,416 to Scharf et al which is incorporated herein by reference.

It is preferred that the phosphite contain from about 8 to about 24 carbon atoms in each of the fatty radicals described as "R". Preferably, the fatty phosphite contains from about 12 to about 22 carbon atoms in each of the fatty radicals, most preferably from about 16 to about 20 carbon atoms in each of the fatty radicals. It is highly preferred that the fatty phosphite be formed from oleyl groups, thus having 18 carbon atoms in each fatty radical.

2. Other friction modifiers which are useful herein are borated fatty epoxides, borated glycerol monocarboxylates, and borated alkoxylated fatty amines. Borated fatty epoxides are known from Canadian Patent No. 1,188,704 which patent is incorporated herein by reference. The oil-soluble boron containing compositions of Davis are prepared by reacting at a temperature from about 80° C. to about 250° C., (A) at least one of boric acid or boron trioxide with (B) at least one epoxide having the formula $$R^1R^2C[O]CR3R^4$$

wherein each of $R^1$, $R^2$, $R^3$ and $R^4$ is hydrogen or an aliphatic radical, or any two thereof together with the epoxy carbon atom or atoms to which they are attached, form a cyclic radical, said epoxide containing at least 8 carbon atoms.

As will be apparent, the borated fatty epoxides are characterized by the method for their preparation which involves the reaction of two materials. Reagent A may be boron trioxide or any of the various forms of boric acid including metaboric acid ($HBO_2$), orthoboric acid ($H_3BO_3$) and tetraboric acid ($H_2B_40_7$). Boric acid, and especially orthoboric acid, is preferred.

Reagent B is at least one epoxide having the above formula and containing at least 8 carbon atoms. In the formula, each of the r values is most often hydrogen or an aliphatic radical with at least one being an aliphatic radical containing at least 6 carbon atoms. The term "aliphatic radical" includes aliphatic hydrocarbon radicals (e.g., hexyl, heptyl, octyl, decyl, dodecyl, tetradecyl, stearyl, hexenyl, oleyl), preferably free from acetylenic unsaturation; substituted aliphatic hydrocarbon radicals including substituents such as hydroxy, nitro, carbalkoxy, alkoxy and alkylthio (especially those containing a lower alkyl radical; i.e., one containing 7 carbon atoms or less); and hetero atom-containing radicals in which the hetero atoms may be, for example, oxygen, nitrogen or sulfur. The aliphatic radicals are preferably alkyl radicals, and more preferably those containing from about 10 to about 20 carbon atoms. Mixtures of epoxides may be use; for example, commercial available $C_{14-16}$ or $C_{14-18}$ epoxides and the like, wherein $R^1$ is a mixture of alkyl radicals having two less carbon atoms than the epoxide. Most desirably, $R^1$ is a straight-chain alkyl radical and especially the tetradecyl radical.

Further useful epoxides are those in which any two of the R radicals form a cyclic radical, which may be alicyclic or heterocyclic. Examples are n butylcyclopentene oxide, n-hexylcyclohexene oxide, methylenecyclo-octene oxide and 2-methylene-3-n-hexyltetrahydrofuran oxide.

The borated fatty epoxides may be prepared by merely blending the two reagents and heating them at temperature from about 80° to about 250° C., preferably from about 100° to about 200° C., for a period of time sufficient for reaction to take place. If desired, the reaction may be effected in the presence of a substantially inert, normally liquid organic diluent such as toluene, xylene, chlorobenzene, dimethylformamide or the like, but the use of such diluents is usually unnecessary. During the reaction, water is evolved and may be removed by distillation.

The molar ratio of reagent A to reagent B is generally between about 1:0.25 and about 1:4. Ratios between 1:1 and about 1:3 are preferred, with 1:2 being an especially preferred ratio.

It is frequently advantageous to employ a catalytic amount of an alkaline reagent to facilitate the reaction. Suitable alkaline reagents include inorganic bases and basic salts such as sodium hydroxide, potassium hydroxide and sodium carbonate; metal alkoxides such as sodium methoxide, potassium t-butoxide and calciumethoxide; heterocyclic amines such as piperidine, morpholine and pyridine; and aliphatic amines such as n-butylamine, di-n hexylamine and tri-n-butylamine. The preferred alkaline reagents are the aliphatic and heterocyclic amines and especially tertiary amines. When the preferred method involving the "heel" is used, the alkaline reagent is typically added to the blend of the "heel" with reagent A.

The molecular structures of the compositions of this invention are not known with certainty. During their preparation, water is evolved in near stoichiometric amounts for conversion of boric acid to boron trioxide when reagent A is boric acid, and gel permeation chromatography of the composition prepared from boric acid and a $C_{16}$ alpha-olefin oxide mixture in a 1:2 molar ratio indicates the presence in substantial amounts of three constituents having approximate molecular weights of 400, 600 and 1200.

3. The borated amines are generally known from European published application Nos. 84 302 342.5 filed Apr. 5, 1984 and 84 307 355.2 filed Oct. 25, 1984, both authorized by Reed Walsh, and U.S. Pat. No. 4,622,158 by the same inventor.

The borated amine friction modifiers are conveniently prepared by the reaction of a boron compounds selected from the group consisting of boric acid, boron trioxide and boric acid esters of the formula $B(OR)_3$ wherein R is a hydrocarbon-based radical containing from 1 to about 8 carbon atoms and preferably from about 1 to about 4 carbon atoms with an amine selected from the group consisting of hydroxy containing tertiary amines corresponding to the formulae $$B—(OR^1)_xNR^2R^3 \quad (A)$$

and $$B—[(OR^1)_xZ]_3 \quad (B)$$

wherein Z is an imidazolene radical, $R^1$ is each formula is a lower alkylene based radical containing from 1 to about 8 carbon atoms, $R^2$ is a radical selected from the group consisting of hydrocarbon based radicals containing from 1 to about 100 carbon atoms and alkoxy radicals of the structure $H(OR^4)y$—where $R^4$ is a lower alkylene based radical containing from 1 to about 8 carbon atoms, $R^3$ and $R^5$ (pendent from the ethylenic carbon in the 2 position in the imidazolene (Z) radical) are each hydrocarbon based radicals containing from 1 to about 100 carbon atoms, x and y are each an integer ranging from at least 1 to about 50 and the sum of x+y is at most 75.

In one embodiment, the amines useful in preparing the organo-borate additive compositions are those tertiary amines corresponding to (A) above wherein $R^2$ is an alkoxy radical of the structure $H(OR^4)_y$—wherein $R^4$ is a lower alkylene radical containing from 1 to about 8 carbon atoms and $R^3$ is an aliphatic based hydrocarbon radical containing from about 8 to about 25 carbon atoms, and preferably from about 10 to about 20 carbon atoms and x and y are each an integer ranging from at least 1 to about 25 and wherein the sum of x+y is at most 50, and those tertiary amines containing the imidazoline structure above wherein $R^1$ is a lower alkylene radical containing from 1 to about 8 carbon atoms, $R^5$ is an aliphatic based hydrocarbon radical, preferably alkyl or alkenyl based radical, containing from about 8 to about 25 carbon atoms and preferably from about 10 to about 20 carbon atoms.

Preferred tertiary amines useful in preparing the multifunctional organoborate additive compositions are those tertiary amines corresponding to formula (A) above wherein $R^2$ is an alkoxy radical of the structure $H(OR^4)_y$—, wherein $R^1$ and $R^4$ are individually ethylene or propylene radicals, $R^3$ is an alkyl or an alkenyl based hydrocarbon radical containing from about 10 to about 20 carbon atoms, x and y are each an integer ranging from at least 1 to about 9 and preferably from at least 1 to about 5 and the sum of x+y is at most 10 and preferably at most 5, i.e., the sum of x+y ranges from about 2 to about 0 and preferably from about 2 to about 5 respectively. Amines, per se, such as oleyl amines are useful as friction modifiers herein.

As used in this specification, the term "hydrocarbon-based radical" denotes a radical having a carbon atom directly attached to the remainder of the molecule and having predominantly hydrocarbon character within the context of this invention. Such radicals include the following:

(1) Hydrocarbon radicals; that is, aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic radicals, and the like as well as cyclic radicals wherein the ring is completed through another portion of the molecule (that is, any two indicated hydrocarbon radicals, e.g., $R^2$ and $R^3$, may together form an alicyclic radical and such radical may contain hetero atoms such as nitrogen, oxygen and sulfur). Such radicals are known to those skilled in the art; representative examples are examples of such radicals as represented by $R^2$, $R^3$ and $R^5$ in the formulae above include methyl, ethyl, butyl, hexyl, octyl, decyl, dodecyl, tetradecyl, octadecyl, eicosyl, cyclohexyl, phenyl and naphthyl and the like including all isomeric forms of such radicals and when $R^2$ and $R^3$ together form an alicyclic radical, then examples of such radicals include morpholinyl, piperidyl, piperazinyl, phenothiazinyl, pyrrolyl, pyrrolidyl, thiazolidinyl and the like.

(2) Substituted hydrocarbon radicals; that is, radicals containing non hydrocarbon substituents which, in the context of this invention, do no alter the predominantly hydrocarbon character of the radical. Those skilled in the art will be aware of suitable substituents; representative examples are hydroxy (HO—); alkoxy (RO—); carbalkoxy ($RO_2C$—); acyl [RC(O—]; acyloxy ($RCO_2$—); carboxamide ($H_2NC(0)$—); acylimidazyl; [RC(NR)—]; and alkylthio (RS—) and halogen atoms (e.g.,F,Cl,Br and I).

Hetero radicals; that is, radicals which, while predominantly hydrocarbon, contain atoms other than carbon present in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbon-based radical.

Terms such as "alkyl-based radical," "alkenyl-based radical" and alkylene-based radical" and the like have analogous meanings with respect to alkyl and aryl radicals and the like.

Representative examples of the tertiary amine compounds useful in preparing the organo-borate compounds of this invention include monoalkoxylated amines such as dimethylethanolamine, diethylethanolamine, dibutylethanolamine, diisopropylethanolamine, di(2-ethylhexyl)ethanolamine, phenylethylethanolamine, and the like and polyalkoxylated amines such as methyldiethanolamine, ethyl diethanolamine, phenyldiethanolamine, diethyleneglycol mono-N-morpholinoethyl ether, N-(2-hydroxyethyl)thiazoli-dine, 3-morpholinopropyl-(2 hydroxyethyl)cocoamine, N-(2-hydroxy-ethyl)-N-tallow-3-aminomethylpropionate, N (2-hydroxyethyl)-N-tallow acetamide, 2-oleoylethyl(2-hydroxyethyl)tallowamine, N [N'-dodecenyl]; N'-[2-hydroxy-ethylaminoethyl]thiazole, 2-methoxyethyl-(2 hydroxyethyl)tallowamine, 1-[N-dodecenyl; N-2-hydroxyethyl-aminoethyl]imidazole, N-N'-octadecenyl-N'-2-hydroxyethyl-aminoethyl] phenothiazine, 2 hydroxydicocamine, 2-heptadecenyl-1 -(2-hydroxyethylimidazoline, 2-dodecyl-1 -(5 hydroxypentyl-imidazoline, 2-(3-cyclohexyl propyl)-1-(2-hydroxyethyl-imidazoline) and the like.

An especially preferred class of tertiary amines useful in preparing the organo borate compounds of the invention is that constituting the commercial alkoxylated fatty amines known by the trademark "ETHOMEEN" and available from the Armak Company. Representative examples of these ETHOMEEN is ETHOMEEN C/12(bis[2 hydroxyethyl] cocoamine); ETHOMEEN C/20 (polyoxyethylene[10] cocoamine); ETHOMEEN S/12(bis[2-hydroxyethyll] soyamine); ETHOMEEN T/12(bis[2 hydroxyethyl] tallowamine); ETHOMEEN T/15(polyoxyethylene-[5] tallowamine); ETHOMEEN 0/12(bis[2-hydroxyethyl]oleyl-amine; ETHOMEEN 18/12(bis[2 hydroxyethyl] octadecylamine; ETHOMEEN 18/25 polyoxyethylene[15] octadecylamine and the like. Of the various ETHOMEEN compounds useful in repairing the organo borate additive compounds of the invention, ETHOMEEN T/12 is most preferred. Fatty amines, as well as being commercially available are also described in U.S. Pat. No. 4,741,848 which is hereby incorporated by reference herein.

If desired, the tertiary amine reactants represented by formulae (A) and (B) above may be reacted first with elemental sulfur to sulfurize any carbon-to-carbon double bond unsaturation which may be present in the hydrocarbon based radicals $R^2$, $R^3$ and $R^5$ when these radicals are, for example, alkenyl radicals (e.g., fatty oil or fatty acid radicals)., Generally the sulfurization reaction will be carried out at temperatures ranging from about 100° C. to about 250° C., and preferably from about 150° C. to about 200° C. The molar ratio of sulfur to amine can range from about 0.5:1.0 to about 3:0:1.0 and preferably 1:0:1.0. Although, generally no catalyst is required to promote sulfurization of any carbon-to-carbon double bond unsaturation which may be present in any tertiary amine reactant useful in preparing the organo-borate compositions of this invention, catalysts may be employed, if desired. If such catalysts are employed, preferably, such catalysts are tertiary hydrocarbon substituted amines, most preferably, trialkylamnes. Representative examples of which include tributylamine, dimethyloctylamine, triethylamine and the like.

The organo-borate additive friction modifiers can be prepared by adding the boron reactant, preferably boric acid, to at least one of the above defined tertiary amine reactants, in a suitable reaction vessel, and heating the resulting reaction mixture at a temperature ranging from about 50° to about 300° C. with continuous stirring. The reaction is continued until by-product water ceases to evolve from the reaction mixture indicating completion of the reaction. The removal of by-product water is facilitated by either blowing an inert gas, such as nitrogen, over the surface of the reaction mixture or by conducting the reaction at reduced pressures. Preferably the reaction between the boron reactant and the tertiary amine will be carried out at temperatures ranging from about 100° C. to about 250° C. and most preferably between about 150° C. and 230° C. while blowing with nitrogen.

Although normally the amines will be liquid at room temperature, in those instances where the amine reactant is a solid or semi-solid, it will be necessary to heat the amine to above its melting point in order to liquify it prior to the addition of the boron-containing reactant thereto. Those of ordinary skill in the art can readily determine the melting point of the amine either from the general literature or through a simple melting point analysis.

Generally, the amine reactant alone will serve as the solvent for the reaction mixture of the boron containing reactant and amine reactant. However, if desired, an inert normally liquid organic solvent can be used such as mineral oil, naphtha, benzene, toluene or xylene can be used as the reaction media. Where the organo-borate additive compound is to be added directly to a lubricating oil, it is generally preferred to conduct the reaction merely using the amine reactant as the sole solvent.

The alkoxylated fatty amines, and fatty amines themselves are generally useful as components of this invention. Both types of amines are commercially available.

The borated fatty acid esters of glycerol are prepared by borating a fatty acid ester of glycerol with boric acid with removal of the water of reaction. Preferably, there is sufficient boron present such that each boron will react with from 1.5 to 2.5 hydroxyl groups present in the reaction mixture.

The reaction may be carried out at a temperature in the range of 60° C. to 135° C., in the absence or presence of any suitable organic solvent such as methanol, benzene, xylenes, toluene, neutral oil and the like.

4. Fatty acid esters of glycerol can be prepared by a variety of methods well known in the art. Many of these esters, such as glycerol monooleate and glycerol tallowate, are manufactured on a commercial scale. The esters useful are oil-soluble and are preferably prepared from $C_8$ to $C_{22}$ fatty acid or mixtures thereof such as are found in natural products. The fatty acid may be saturated or unsaturated. Certain compounds found in acids from natural sources may include licanic acid which contains one keto group. Most preferred $C_8$ to $C_{22}$ fatty acids are those of the formula RCOOH wherein R is alkyl or alkenyl.

The fatty acid monoester of glycerol is preferred, however, mixtures of mono and diesters may be used. Preferably any mixture of mono- and diester contains at least 40% of the monoester. Most preferably, mixtures of mono- and diesters of glycerol contain from 40 to 60 percent by weight of the monoester. For example, commercial glycerol monooleat contains a mixture of from 45% to 55% by weight monoester and from 55% to 45% diester.

Preferred fatty acids are oleic, stearic, isostearic, palmitic, myristic, palmitoleic, linoleic, lauric, linolenic, and eleostearic, and the acids from the natural products tallow, palm oil, olive oil, peanut oil, corn oil, Neat's foot oil and the like. A particularly preferred acid is oleic acid. The borated fatty acid esters are conveniently stabilized against hydrolysis by reacting the esters with an alkyl or alkenyl mono-or bis succinimide.

Additional ingredients which may be included in lubricant and functional fluid of the present invention are fatty acid amides which are useful as additional friction modifiers, particularly for reducing the static coefficient of friction.

In general a fatty acid with ammonia is an organic amine to produce the desired amide. Also, many amides are commercially available. Also commercially available are the fatty imidazolines which comprise a part of this invention.

A sulfurized olefin is included in the present invention as a friction modifier which also functions as an extreme pressure agent. Extreme pressure agents are materials which retain their character and prevent metal to metal damage, e.g., contact, when gears are engaged and meshed. The sulfurization of olefins is generally known as is evidenced by U.S. Pat. No. 4,191,659 as previously disclosed.

The sulfurized olefins which are useful in the present invention are those materials formed from olefins which have been reacted with sulfur. Thus, an olefin is defined as a compound having a double bond connecting two aliphatic carbon atoms. In its broadest sense, the olefin may be defined by the formula $R^1R^2C{=}CR^3R^4$, wherein each of $R^1$, $R^2$, $R^3$ and $R^4$ is hydrogen or an organic radical. In general, the R values in the above formula which are not hydrogen may be satisfied by such groups as $—C(R^5)_3$,$—COOR^5$, $—CON(R^5)_2$,$—COON(R^5)_4$,—COOM,—CN, $—C(R^5){=}C(R^5)_2$, $—C(R^5)_2{=}Y—X$,$—YR^5$ or—Ar.

Each $R^5$ is independently hydrogen, alkyl, alkenyl, aryl, substituted alkyl, substituted alkenyl or substituted aryl, with the proviso that any two $R^5$ groups can be alkylene or substituted alkylene whereby a ring of up to about 12 carbon atoms is formed;

M is one equivalent of a metal cation (preferably Group I or II, e.g., sodium, potassium, magnesium, barium, calcium);

X is halogen (e.g, chloro, bromo, or iodo);

Y is oxygen or divalent sulfur; and

Ar is an aryl or substituted aryl radical of up to about 12 carbon atoms.

Any two of $R^1$, $R^2$, $R^3$ and $R^4$ may also together form an alkylene or substituted alkylene group; i.e., the olefinic compound may be alicyclic.

The nature of the substituents in the substituted moieties described above are not normally a critical aspect of the invention and any such substituent is useful so long as it is, or can be made compatible, with lubricating environments and does not interfere under the contemplated reaction conditions. Thus, substituted compounds which are so unstable as to deleteriously decompose under the reaction conditions employed are not contemplated. However, certain substituents such as keto or aldehydo can desirably undergo sulfurization. The selection of suitable substituents is within the skill of the art of may be established through routine testing. Typical of such substituents include any of the above-listed moieties as well as hydroxy, amidine, amino, sulfonyl, sulfinyl, sulfonate, nitro, phosphate, phosphite, alkali metal mercapto and the like.

The olefinic compound is usually one in which each R value which is not hydrogen is independently alkyl, alkenyl or aryl, or (less often) a corresponding substituted radical. Monoolefinic and diolefinc compounds, particularly the former, are preferred, and especially terminal monoolefinic hydrocarbons; that is, those compounds in which $R^3$ and $R^4$ are hydrogen and $R^1$ and $R^2$ are alkyl or aryl, especially alkyl (that is, the olefin is aliphatic). Olefinic compounds having about 3 to 30 and especially about 3 to 18 (most often less than 9) carbon atoms are particularly desirable.

Isobutene, propylene and their oligomers such as dimers, trimers and tetramers, and mixtures thereof are especially preferred olefinic compounds. Of these compounds, isobutylene and diisobutylene are particularly desirable because of their availability and the particularly desirable because of their availability and the particularly high sulfur containing composition which can be prepared therefrom.

Also included in the additive package are extreme pressure agents/antiwear compositions which protect moving parts from wear. These components act by coating metal parts with a protective film. Preferred antiwear agents are metal salts of phosphorodithioic acid. The metals are Group II metals such as aluminum. tin. cobalt, lead, molybdenum, manganese, nickel and zinc with zinc being preferred. Mixtures of two or more metal salts may be used.

The phosphorodithioic acid are represented by formula

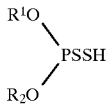

I wherein $R^1$ and $R^2$ are the same or different and $R^1$ and $R^2$ are hydrocarbon based groups.

The phosphorus acids can be prepared by methods well known in the art and generally are prepared by the reaction of phosphorus pentasulfide ($P_2S_5$) with an alcohol or a phenol, or a mixture of alcohols. The reaction involves mixing at a temperature of about 20° to about 200° C., four moles of the alcohol or phenol with one mole of phosphorus pentasulfide. Hydrogen sulfide is liberated in this reaction.

Preferably, the hydrocarbon-based groups in the compounds useful as component (I) according to this invention are free from acetylenic and usually also from ethylenic unsaturation and have from 1 to about 50 carbon atoms, preferably 1 to about 30 carbon atoms, and more preferably from about 3 to about 18 carbon atoms. $R^1$ and $R^2$ are most often identical, although they may be different and either or both may be mixtures. The groups are usually hydrocarbon, preferably alkyl, and most desirably branched alkyl. Examples of $R^1$ and $R^2$ groups include isopropyl, isobutyl, 4-methyl-2-pentyl, 2-ethylhexyl, isooctyl, etc.

The metal salts of the phosphorodithioic acid are prepared by reacting the acid with suitable metal bases. The metal bases include the free metals enumerated above and their oxides, hydroxides, alkoxides and basic salts. Examples are sodium hydroxide, sodium methoxide, sodium carbonate, potassium hydroxide, potassium carbonate, magnesium oxide, magnesium hydroxide, calcium acetate, zinc oxide, zinc acetate, lead oxide, nickel oxide and the like.

The temperature at which the metal salts of this invention are prepared is generally between about 30° and about 150° C., preferably up to about 125° C.

It is frequently advantageous to conduct the reaction in the presence of a substantially inert, normally liquid organic diluent such as naphtha, benzene, xylene, mineral oil or the like. If the diluent is mineral oil or is physically and chemically similar to mineral oil, it frequently need not be removed before using the metal salts in the composition, concentrates and functional fluids of the invention.

The preparation of the metal salts useful in this invention is illustrated by the following examples. All parts and percentages are by weight.

The term "neutral salt" refers to salts characterized by metal content equal to that which would be present according to the stoichiometry of the metal and the particular organic compound reacted with the metal. Thus, if a phosphorodithioic acid, $(RO)_2PSSH$, is neutralized with a basic metal compound, e.g., zinc oxide, the neutral metal salt produced would contain one equivalent of zinc for each equivalent of acid, i.e., $[(RO)_2PSS]_2Zn$.

However, with the present invention, the metal product can contain more or less than the stoichiometric amount of metal. The products containing less than the stoichiometric amount of metal are acidic materials. The products containing more than the stoichiometric amount of metal are overbased materials. For example, salts containing 80% of the metal present in the corresponding neutral salt are acidic, while salts containing 110% of the metal present in the corresponding neutral salt are overbased. The metal components may have about 80% to about 200%, preferably about 100% to about 150%, more preferably about 100% to about 135%, and advantageously about 103% to about 110% of the metal present in the corresponding neutral salt.

Preferred metal salt of the present invention is zinc diisooctyl dithiophosphate and zinc dibenzyl dithiophosphate.

The dithiophosphates are present in the additive package at about 5–20 weight percent and in the fluid blend at 0.1–5% by weight. The preferred range is 1–3% of the fluid blend.

It should be noted that the zinc dithiophosphate also serves an antioxidant function.

For a discussion of phosphorus containing metal salts see Grover in U.S. Pat. No. 4,466,894 which is incorporated by reference for disclosure pertinent to this invention.

The sulfurization of such compounds is conducted as is known in the art and thus no further discussion of the sulfurized olefin component is given at this point.

The amount of the friction modifier employed in the additive package of the present invention is typically from about 0.1% to about 20%, preferably from about 1.0% to about 12%, and most preferably from about 0.5% to about 10 by weight of the total composition. Said percentages are on an oil free basis.

Several additional components are desirably added to the ATF fluid of the present invention for instance Viscosity Index Modifiers (VIM) may be added in the weight range of up to 30% of the final ATF blend based on an oil free basis for the VIM. As is well known in the art, useful viscosity index improvers are polyisobutylenes, polymerized and co-polymerized alkyl methacrylates, and mixed esters of styrene maleic anhydride interpolymers reacted with nitrogen containing compounds. The molecular weight of the VIM is selected by the formulation to give the final ATF the desired viscosity.

As is well known in the art, some of the listed-above VIM are classified as dispersant-viscosity modifiers (dispersant-VM) because of their dual function. A detailed description of dispersant-VM is presented in U.S. Pat. No. 4,594,378 which is incorporated herein by reference for its disclosure of dispersant-VM. The dispersant-VM disclosed in the '378 patent are (B-1), at least one nitrogen-containing ester of a carboxylic-containing interpolymer and/or (B-2), at least one oil-soluble acrylate-polymerization product of at least one acrylate ester, or a mixture of (B-1) and (B-2)

Commercially available dispersant-VM are sold under trade names Acryloid® 1263 and 1265 by Rohm and Haas®, Viscoplex® 5151 and 5089 by Rohm-GMBHO® and Lubrizol® 3702 and 3715. Dispersant-VM may be used in the final ATF blend at the same level as the viscosity index improvers described above. A preferred range for the dispersant-viscosity modifier in the final ATF is in the range of 0.5–10 weight percent based on the weight of the ATF.

Other components which the final additive package may contain properties are dibutylphosphite antiwear agent in a weight percent range of 0.1–5 based on the final ATF weight; synthetic seal swell agent comprising a sulfolane or equivalent in the amount of 0.1–5 weight based on the weight of the final ATF weight.

The lubricating compositions can also include at least one phosphorus acid, ester or derivative thereof. The phosphorus acids, esters or derivatives thereof include compounds selected from the group consisting of phosphorus acid esters or salts thereof, phosphites, phosphorus containing amides, phosphorus-containing carboxylic acids or esters, phosphorus containing ethers and mixtures thereof.

In one embodiment, the phosphorus acid, ester or derivative can be a phosphorus acid, phosphorus acid ester, phosphorus acid salt, or derivative thereof The phosphorus acids include the phosphoric, phosphonic, phosphinic, and thiophosphoric acids including dithiophosphoric acid as well as the monothiophosphoric, thiophosphinic and thiophosphonic acids.

Eighty-five percent phosphoric acid is the preferred compound for addition to the fully-formulated ATF package and is included at a level of about 0.01–3 weight percent based on the weight of the ATF.

Friction modifiers also include metal salts of fatty acids. Preferred cations are zinc, magnesium, calcium, barium and sodium and any alkaline, or alkaline earth metals may be used. The salts may be overbased by including an excess of cations per equivalent of amine. The excess cations is then treated with carbon dioxide to form the carbonate. The metal salts are prepared by reacting a suitable salt with the acid to form the salt, and where appropriate adding carbon dioxide to the reaction mixture to form the carbonate of any cation beyond that needed to form the salt. A preferred friction modifier is zinc oleate.

EXAMPLE

To a mixture of a fatty acid, oil and an aliphatic alcohol (preferably about $C_3$–$C_8$) at about 100°–140° C. is added calcium chloride in an amount in which Ca ion exceeds the equivalents of acid. The reaction is heated to 200° for about two hours, then the temperature is raised to 300° C. to distill solvent. The reaction is cooled to 100°–125° and carbonated with carbon dioxide to form the overbased carbonate. The product is then taken up in oil and provides a product roughly half and half oil metal salt. The TBN of a typical salt is 50–200.

Optionally antioxidants in the forms of sulfides and mono- and di-alkylated diphenylamines may be added to the final ATF blend in the amount of up to 10 weight percent on an oil free basis each based on the weight of the final ATF blend. Silicone anti-foam compositions may also be added to the final ATF blend in the amount of about 40–400 parts per million based on ATF blend. Also pour point depressants can be included in the final ATF blend at up to about 10% by weight based on the final weight of said ATF blend. An example of a pour point depressant is an alkylene coupled napthalene.

Also included in the final ATF blend is a dispersant or mixtures thereof in weight percents of up to about 20% of the final blend on an oil free basis. Dispersants in general comprise an oil soluble function such as a polybutene, a polar group such as a polyamine or polyalcohol or mixture thereof, and a bridge portion to join in the previous two. The bridge is commonly a succan molecule or the like. The polybutene is preferably polyisobutylene with number average molecular weight, Mn of 1000–2000, but Mn of 500–4000 may be useful.

Dispersants used in this invention comprise: (A) an acylated amine having a base number in the range of about 45 to about 90, said acylated amine being the product made by contacting (A)(I) at least one carboxylic acid acylating agent with (A)(II) at least one polyamine, said polyamine (A)(II) being selected from the group consisting of (A)(II)(a) a product made by contacting at least one hydroxy material with at least one amine, (A)(II)(b) an alkylene polyamine bottoms product, and (A)(II)(c) a product made by contacting a hydroxy material with an alkylene polyamine bottoms product; (B) a boron compound; and (C) an organic phosphorus acid or ester, or derivative of said phosphorus acid or ester. In one embodiment, this composition further comprises (D) a thiocarbamate. In one embodiment, this composition further comprises (E) a nitrogen containing ester of a carboxy-containing interpolymer. These compositions are useful as additives for lubricants and functional fluids, and are particularly useful as additives for automatic transmission fluids for enhancing the torque characteristics such automatic transmission fluids.

As used in this specification and in the appended claims, the term "hydrocarbyl" denotes a group having a carbon atom directly attached to the remainder of the molecule and having a hydrocarbon or predominantly hydrocarbon character within the context of this invention. Such groups include the following:

(1) Hydrocarbon groups; that is, aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Such groups are known to those skilled in the art. Examples include methyl, ethyl, octyl, decyl, octadecyl, cyclohexyl, phenyl, etc (2) Substituted hydrocarbon groups; that is, groups containing non-hydrocarbon substituents which, in the context of this invention, do not alter the predominantly hydrocarbon character of the group. Those skilled in the art will be aware of suitable substituents. Examples include halo, hydroxy, nitro, cyano, alkoxy, acyl, etc.

(3) Hetero groups; that is, groups which, while predominantly hydrocarbon in character within the context of this invention, contain atoms other than carbon in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbyl group.

Terms such as "alkyl-based," "aryl-based," and the like have meanings analogous to the above with respect to alkyl groups, aryl groups and the like.

The term "hydrocarbon-based" has the same meaning and can be used interchangeably with the term hydrocarbyl when referring to molecular groups having a carbon atom attached directly to the remainder of a molecule.

The term "lower" as used herein in conjunction with terms such as hydrocarbyl, alkyl, alkenyl, alkoxy, and the like, is intended to describe such groups which contain a total of up to 7 carbon atoms.

The term "oil-soluble" refers to a material that is soluble in mineral oil to the extent of at least about one gram per liter at 25° C.

(A) Acylated Amines.

The acylated amines (A) that are useful with the inventive automatic transmission fluids are made by contacting (A)(I) a carboxylic acid acylating agent with (A)(II) a polyamine to provide an acylated amine characterized by a base number in the range of about 45 to about 90, and in one embodiment about 45 to about 70. The term "base number" or "total base number (TBN)" as used herein refers to the amount of acid (perchloric or hydrochloric) needed to neutralize the product (A), excluding diluent oil and unreacted components, expressed as KOH equivalents.

(A)(I) Carboxylic Acid Acylating Agents.

The acylating agents (A)(I) are well known in the art and have been found to be useful as additives for lubricants and fuels and as intermediates for preparing the same. See, for example, the following U.S. Patents which are hereby incorporated by reference for their disclosures relating to carboxylic acid acylating agents: U.S. Pat. Nos. 3,219,666; 3,272,746; 3,381,022; 3,254,025; 3,278,550; 3,288,714; 3,271,310; 3,373,111; 3,346,354; 3,272,743; 3,374,174; 3,307,928; and 3,394,179.

Generally, these carboxylic acid acylating agents are prepared by reacting an olefin polymer or chlorinated analog thereof with an unsaturated carboxylic acid or derivative thereof such as acrylic acid, fumaric acid, maleic anhydride and the like. Often they are polycarboxylic acylating agents such as hydrocarbyl-substituted succinic acids and anhydrides. These acylating agents generally have at least one hydrocarbyl substituent of at least about 8 carbon atoms, and in one embodiment at least about 12 carbon atoms, and in one embodiment at least about 20 carbon atoms, and in one embodiment at least about 30 carbon atoms, and in one embodiment at least about 50 carbon atoms. Generally, this substituent has an average of about 12 or about 20, typically about 30 or about 50 up to about 300 or about 500 carbon atoms; often it has an average of about 50 to about 250 carbon atoms.

The olefin monomers from which the olefin polymers are derived are polymerizable olefins and monomers characterized by having one or more ethylenic unsaturated group. They can be monoolefinic monomers such as ethylene, propylene, butene-1, isobutene and octene-1 or polyolefinic monomers (usually di-olefinic monomers such as butadiene-1,3 and isoprene). Usually these monomers are terminal olefins, that is, olefins characterized by the presence of the group $>C{=}CH_2$. However, certain internal olefins can also serve as monomers (these are sometimes referred to as medial olefins). When such medial olefin monomers are used, they normally are employed in combination with terminal olefins to produce olefin polymers which are interpolymers. Although the hydrocarbyl-based substituents may also include aromatic groups (especially phenyl groups and lower alkyl and/or lower alkoxy-substituted phenyl groups such as para(tertiary butyl)-phenyl groups) and alicyclic groups such as would be obtained from polymerizable cyclic olefins or alicyclic-substituted polymerizable cyclic olefins. The olefin polymers are usually free from such groups. Nevertheless, olefin polymers derived from such interpolymers of both 1,3-dienes and styrenes such as butadiene-1,3 and styrene or para(tertiary butyl)styrene are exceptions to this general rule.

Generally, the olefin polymers are homo- or interpolymers of terminal hydrocarbyl olefins of about 2 to about 16 carbon atoms. A more typical class of olefin polymers is selected from that group consisting of homo- and interpolymers of terminal olefins of 2 to 6 carbon atoms, especially those of 2 to 4 carbon atoms.

Specific examples of terminal and medial olefin monomers which can be used to prepare the olefin polymers from which the hydrocarbyl substituents are derived include ethylene, propylene, butene-1, butene-2, isobutene, pentene-1, hexene-1, heptene-1, octene-1, nonene-1, decene-1, pentene-2, propylene tetramer, diisobutylene, isobutylene trimer, butadiene-1,2, butadiene-1,3, pentadiene-1,2, pentadiene-1,3, isoprene, hexadiene-1,5, 2-chlorobutadiene-1, 3, 2-methylheptene-1, 3 -cyclohexyl butene-1, 3,3 -dimethylpentene-1, styrenedivinylbenzene, vinylacetate allyl alcohol, 1-methylvinylacetate, acrylonitrile, ethylacrylate, ethylvinylether and methylvinylketone. Of these, the purely hydrocarbyl monomers are more typical and the terminal olefin monomers are especially typical.

Often the olefin polymers are poly(isobutenes) such as obtained by polymerization of a $C_4$ refinery stream having a butene content of about 35% to about 75% by weight and an isobutene content of about 30% to about 60% by weight in the presence of a Lewis acid catalyst such as aluminum chloride or boron trifluoride. These polyisobutenes usually contain predominantly (that is, greater than 80% of the total repeat units) isobutene repeat units of the configuration

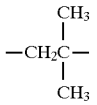

Often the acylating agents (A)(I) are substituted succinic acids or anhydrides which can be represented by the formulae

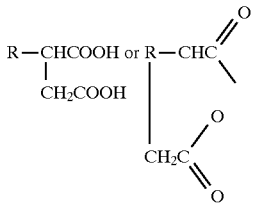

wherein R is a hydrocarbyl group (eg., alkyl or alkenyl) of about 12 to 500 carbon atoms, and in one embodiment about 30 to about 500 carbon atoms, and in one embodiment about 50 to about 500 carbon atoms.

These succinic acid acylating agents can be made by the reaction of maleic anhydride, maleic acid, or fumaric acid with the afore-described olefin polymer, as is shown in the patents cited above. Generally, the reaction involves merely heating the two reactions at a temperature of about 150° C. to about 200° C. Mixtures of the afore-said polymeric olefins, as well as mixtures of unsaturated mono- and dicarboxylic acids can also be used.

In one embodiment the acylating agent (A)(I) is a substituted succinic acid or anhydride, said substituted succinic acid or anhydride consisting of substituent groups and succinic groups wherein the substituent groups are derived from polybutene in which at least about 50% of the total units derived from butenes is derived from isobutylene. The polybutene has an $\overline{Mn}$ value of about 800 to about 1200 and an $\overline{Mw}$ 1 $\overline{Mt}$ value of about 2 to about 3. The acids or anhydrides are characterized by the presence within their structure of an average of about 0.9 to about 1.2 succinic groups for each equivalent weight of substituent groups. For purposes of this invention, the number of equivalent weights of substituent groups is the number corresponding to the quotient obtained by dividing the $\overline{Mn}$ value of the polyalkene from which the substituent is derived into the total weight of the substituent groups present in the substituted succinic acid. Thus, if a substituted succinic acid is characterized by a total weight of substituent group of 40,000 and the $\overline{Mn}$ value for the polyalkene from which the substituent groups are derived is 2000, then that substituted succinic acylating agent is characterized by a total of 20 (40,000/2000=20) equivalent weights of substituent groups.

(A)(II) Polyamine.

The polyamine (A)(II) is selected from the group consisting of (A)(II)(a) a condensed polyamine derived from at least one hydroxy material and at least one amine, (A)(II)(b) an alkylene polyamine bottoms product, or (A)(II)(c) a condensed polyamine derived from at least one hydroxy material and at least one alkylene polyamine bottoms product.

Hydroxy Material Used in Making Condensed Polyamines (A)(II)(a) and (A)(II)(c).

The hydroxy material used in making (A)(II)(a) or (A)(II)(c) can be any hydroxy material that will condense with the amine reactants referred to above and discussed below. These hydroxy materials can be aliphatic, cycloaliphatic or aromatic alcohols. These alcohols can be monohydric or polyhydric.

The hydroxy materials include alkylene glycols and polyoxyalkylene alcohols such as polyoxyethylene alcohols, polyoxypropylene alcohols, polyoxybutylene alcohols, and the like. These polyoxyalkylene alcohols (sometimes called polyglycols) can contain up to about 150 oxyalkylene groups, with the alkylene group containing from about 2 to about 8 carbon atoms. Such polyoxyalkylene alcohols are generally dihydric alcohols. That is, each end of the molecule terminates with an OH group. In order for such polyoxyalkylene alcohols to be useful, there must be at least one such OH group. However, the remaining OH group can be esterified with a monobasic, aliphatic or aromatic carboxylic acid of up to about 20 carbon atoms such as acetic acid, propionic acid, oleic acid, stearic acid, benzoic acid, and the like. The monoethers of these alkylene glycols and polyoxyalkylene glycols are also useful. These include the monoaryl ethers, monoalkyl ethers, and monoaralkyl ethers of these alkylene glycols and polyoxyalkylene glycols. This group of alcohols can be represented by the formula $$HO—(—R^1O—)_pR^2—OR^3$$

wherein $R^1$ and $R^2$ are independently alkylene groups of from about 2 to 8 carbon atoms; and $R^3$ is aryl (e.g., phenyl), lower alkoxy phenyl, or lower alkyl phenyl, or lower alkyl (e.g., ethyl, propyl, terbutyl, pentyl, etc.); and aralkyl (e.g., benzyl, phenylethyl, phenylpropyl, p-ethylphenylethyl, etc.); p is from zero to about eight, preferably from about 2 to 4. Polyoxyalkylene glycols where the alkylene groups are ethylene or propylene and p is at least two as well as the monoethers thereof as described above are useful.

The hydroxy materials that are useful include polyhydroxy aromatic compounds, especially the polyhydric phenols and naphthols. These hydroxy substituted aromatic compounds may contain other substituents in addition to the hydroxy substituents such as halo, alkyl, alkenyl, alkoxy, alkylmercapto, nitro and the like. Usually, the hydroxy aromatic compound will contain from 1 to about 4 hydroxy groups. The aromatic hydroxy compounds are illustrated by the following specific examples: beta-naphthol, alpha-naphthol, cresols, resorcinol, catechol, thymol, eugenol, p,p'-dihydroxy-biphenyl, hydroquinone , pyrogallol , phloroglucinol , hexylresorcinol, 4,4'-methylene-bis-methylene-bis-phenol, alpha-decyl-beta-naphthol, the condensation product of heptylphenol with about 0.5 mole of formaldehyde, the condensation product of octylphenol with acetone, di(hydroxyphenyl)oxide, di-(hydroxyphenyl) sulfide, and di(hydroxyphenyl)-disulfide.

Examples of monohydric alcohols which can be used include methanol, ethanol, isooctanol, dodecanol, cyclohexanol, cyclopentanol, behenyl alcohol, hexatriacontanol, neopentyl alcohol, isobutyl alcohol, benzyl alcohol, beta-phenylethyl alcohol, 2-methylcyclohexanol, beta-chloroethanol, monomethyl ether of ethylene glycol, monobutyl ether of ethylene.

Other specific alcohols that can be used are the ether alcohols and amino alcohols including, for example, the oxyalkylene-, oxyarylene-, aminoalkylene-, and amino-arylene-substituted alcohols having one or more oxyalkylene, aminoalkylene or amino-aryleneoxy-arylene groups. These alcohols are exemplified by the Cellosolves, (products of Union Carbide identified as mono- and dialkyl ethers of ethylene glycol and their derivatives), the Carbitols (products of Union Carbide identified as mono- and dialkyl ethers of diethylene glycol and their derivatives), mono-(heptylphenyloxypropylene)-substituted glycerol, poly (styreneoxide), aminoethanol, di(hydroxyethyl)amine, N,N,N',N'-tetrahydroxytrimethylenediamine, and the like.

In one embodiment, the polyhydric alcohols contain from 2 to about 10 hydroxy groups. These are illustrated, for example, by the alkylene glycols and polyoxyalkylene glycols mentioned above such as ethylene glycol, diethylene glycol, triethylene glycol, tetraethylene glycol, dipropylene glycol, tripropylene glycol, dibutylene glycol, tributylene glycol, and other alkylene glycols and polyoxyalkylene glycols in which the alkylene groups contain from 2 to about 8 carbon atoms.

Useful alcohols also include those polyhydric alcohols containing up to about 12 carbon atoms, and especially those containing from about 3 to about 10 carbon atoms. This class of alcohols includes glycerol, erythritol, pentaerythritol, dipentaerythritol, gluconic acid, glyceraldehyde, glucose, arabinose, 1,7-heptanediol, 2,4-heptanediol, 1,2,3-hexanetriol, 1,2,4-hexanetriol, 1,2,5-hexanetriol, 2,3,4-hexanetriol, 1,2,3-butanetriol, 1,2,4-butanetriol, quinic acid, 2,2,6,6-tetrakis-(hydroxymethyl)cyclohexanol, 1,10-decanediol, digitalose, and the like. Aliphatic alcohols containing at least about 3 hydroxyl groups and up to about 10 carbon atoms are useful.

Amino alcohols contemplated as suitable for use as the hydroxy containing reactant include those amino alcohols having two or more hydroxy groups. Examples of suitable amino alcohols are the N-(hydroxy-lower alkyl)amines and polyamines such as di-(2-hydroxyethyl)-amine, tris (hydroxymethyl)amino methane (THAM), tri-(2-hydroxyethyl)amine, N,N,N'-tri-(2-hydroxyethyl) ethylenediamine, N-(2-hydroxypropyl)-5-carbethoxy-2-piperidone, and ethers thereof with aliphatic alcohols, especially lower alkanols, N,N-di-(3-hydroxypropyl) glycine, and the like. Also contemplated are other poly-N-hydroxyalkyl-substituted alkylene polyamines wherein the alkylene polyamine are as described above; especially those that contain 2 to 3 carbon atoms in the alkylene radicals.

A group of alcohols representative of the above compounds can be represented by the formula $$(R)_n—Y—(X)_q—(AOH)_m$$

wherein R is independently hydrogen or a hydrocarbyl, Y represents S, N, or O; A and X each independently represent an alkylene group; n is 0, 1 or 2 dependent upon m and q, where q is O or 1 and m is 1, 2, or 3.

Polyoxyalkylene polyols which have two or three hydroxyl groups and contain hydrophobic portions represented by the formula $$—\underset{\underset{R^1}{|}}{CH}CH_2O—$$

wherein $R^1$ is a lower alkyl of up to 3 carbon atoms, and hydrophilic portions containing $—CH_2CH_2O—$ groups are useful. These polyols can be prepared by first reacting a compound of the formula $R^2(OH)_q$ where q is 2–3 and $R^2$ is hydrocarbyl with a terminal alkylene oxide of the formula $$R^1—\underset{\underset{O}{\diagdown\ \diagup}}{CH—CH_2}$$

and then reacting that product with ethylene oxide. $R^2(OH)_q$ can also be, for example, trimethylolpropane, trimethylolethane, ethylene glycol, trimethylene glycol, tetramethylene glycol, tri-(beta-hydroxypropyl)amine, 1,4-(2-hydroxyethyl)cyclohexane, tris-(hydroxymethyl)amino methane, 2-amino-2-methyl-1,3 -propanediol, N,N,N',N'-tetrakis(2-hydroxypropyl)-ethylene diamine, N,N,N',N'-tetrakis(2-hydroxyethyl)-ethylene diamine, resorcinol, and the like. The foregoing described $R^2(OH)q$ polyols may also be used alone as the hydroxy containing reactant.

Other hydroxy-containing reactants that can be used are hydroxyalkyl, hydroxy alkyl oxyalkyl and hydroxy aryl sulfides of the formula $S_f(ROH)_{2f}$ wherein f is 1 or 2, and R is an alkyl of 1 to about 10 carbon atoms or an alkyl oxyalkyl where the alkyl is 1 to about 10 carbon atoms and in one embodiment 2 to about 4 carbon atoms, and aryl is at least 6 carbon atoms. Examples include 2,2'-thiodiethanol and 2,2'-thiodipropanol.

Amines Useful in Making the Polyamines (A)(II)(a).

The amines useful in making the polyamines (A)(II)(a) include primary amines and secondary amines. These amines are characterized by the presence within their structure of at least one H—N< group and/or at least one —$NH_2$ group. These amines can be monoamines or polyamines, with the polyamines being preferred. Mixtures of two or more amines can be used.

The amines can be aliphatic, cycloaliphatic, aromatic or heterocyclic, including aliphatic-substituted aromatic, aliphatic-substituted cycloaliphatic, aliphatic-substituted heterocyclic, cycloaliphatic-substituted aliphatic, cycloaliphatic substituted aromatic, cycloaliphatic-substituted heterocyclic, aromatic-substituted aliphatic, aromatic-substituted cycloaliphatic, aromatic-substituted heterocyclic, heterocyclic-substituted aliphatic, heterocyclic-substituted cycloaliphatic and heterocyclic-substituted aromatic amines. These amines may be saturated or unsaturated. If unsaturated, the amine is preferably free from acetylenic unsaturation. The amines may also contain non-hydrocarbon substituents or groups as long as these groups do not significantly interfere with the reaction of the amines with the hydroxy materials used in making the condensed polyamines (A)(II)(a). Such non-hydrocarbon substituents or groups include lower alkoxy, lower alkyl, mercapto, nitro, and interrupting groups such as —O— and —S— (e.g., as in such groups as —$CH_2CH_2$—X—$CH_2CH_2$— where X is —O— or —S—).

With the exception of the branched polyalkylene polyamines, the polyoxyalkylene polyamines and the high molecular weight hydrocarbyl-substituted amines described more fully hereinafter, the amines used in this invention ordinarily contain less than about 40 carbon atoms in total and usually not more than about 20 carbon atoms in total.

Aliphatic monoamines include mono-aliphatic and di-aliphatic-substituted amines wherein the aliphatic groups can be saturated or unsaturated and straight or branched chain. Thus, they are primary or secondary aliphatic amines. Such amines include, for example, mono- and di-alkyl-substituted amines, mono- and di-alkenyl-substituted amines, and amines having one N-alkenyl substituent and one N-alkyl substituent, and the like. The total number of carbon atoms in these aliphatic monoamines preferably does not exceed about 40 and usually does not exceed about 20 carbon atoms. Specific examples of such monoamines include ethylamine, di-ethyl amine, n-butylamine, di-n-butylamine, allylamine, isobutylamine, cocoamine, stearylamine, laurylamine, methyllaurylamine, oleylamine, N-methyl-octylamine, dodecylamine, octadecylamine, and the like. Examples of cycloaliphatic-substituted aliphatic amines, aromatic-substituted aliphatic amines, and heterocyclic-substituted aliphatic amines, include 2-(cyclohexyl)-ethylamine, benzylamine, phenylethylamine, and 3-(furylpropyl) amine.

Examples of useful polyamines include N-aminopropyl-cyclohexyl amine, N-N'-di-n-butyl-para-phenylene diamine, bis-(para-aminophenyl)methane, 1,4-diaminocyclohexane, and the like.

Heterocyclic monoamines and polyamines can be used. As used herein, the terminology "heterocyclic mono- and polyamine(s)" is intended to describe those heterocyclic amines containing at least one primary or secondary amino group and at least one nitrogen as a heteroatom in the heterocyclic ring. These heterocyclic amines can be saturated or unsaturated and can contain various substituents such as nitro, alkoxy, alkyl mercapto, alkyl, alkenyl, aryl, alkaryl, or aralkyl substituents. Generally, the total number of carbon atoms in the substituents will not exceed about 20. Heterocyclic amines can contain more than one nitrogen heteroatom. The 5- and 6-membered heterocyclic rings are preferred.

Among the suitable heterocyclics are aziridines, azetidines, azolidines, tetra- and di-hydropyridines, pyrroles, indoles, piperadines, imidazoles, di- and tetra-hydroimidazoles, piperazines, isoindoles, purines, morpholines, thiomorpholines, N-aminoalkyl-morpholines, N-arninoalkylthiomorpholines, N-aminoalkyl-piperazines, N,N'-di-aminoalkylpiperazines, azepines, azocines, azonines, azecines and tetra-, di- and perhydroderivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, amino alkyl—substituted piperidines, piperazine, aminoalkyl-substituted piperazines, morpholine, aminoalkyl-substituted morpholines, pyrrolidine, and aminoalkyl-substituted pyrrolidines, are useful. Usually the aminoalkyl substituents are substituted on a nitrogen atom forming part of the hetero ring. Specific examples of such heterocyclic amines include N-aminopropylmorpholine, N-aminoethylpiperazine, and N,N'-di-aminoethylpiperazine.

Also suitable as amines are the amino sulfonic acids and derivatives thereof corresponding to the formula:

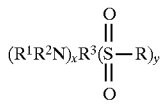

wherein R is OH, $NH_2$, $ONH_4$, etc.; $R^3$ is a polyvalent organic group having a valence equal to x+y; $R^1$ and $R^2$ are each independently hydrogen, hydrocarbyl or substituted hydrocarbyl with the proviso that at least one of $R^1$ and $R^2$ is hydrogen; x and y are each integers equal to or greater than one. Each aminosulfonic reactant is characterized by at least one HN< or $H_2N$-group and at least one

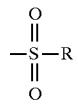

group. These sulfonic acids can be aliphatic, cycloaliphatic or aromatic aminosulfonic acids and the corresponding functional derivatives of the sulfo group. Specifically, the aminosulfonic acids can be aromatic aminosulfonic acids, that is, where $R^3$ is a polyvalent aromatic group such as phenylene where at least one

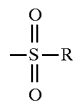

group is attached directly to a nuclear carbon atom of the aromatic group. The aminosulfonic acid may also be a mono-amino aliphatic sulfonic acid; that is, an acid where x is one and $R^3$ is a polyvalent aliphatic group such as ethylene, propylene, trimethylene, and 2-methylene propylene. Other suitable aminosulfonic acids and derivatives thereof useful as amines in this invention are disclosed in U.S. Pat. Nos. 3,029,250; 3,367,864; and 3,926,820; which are incorporated herein by reference.

The high molecular weight hydrocarbyl polyamines which can be used as amines in this invention are generally prepared by reacting a chlorinated polyolefin having a molecular weight of at least about 400 with ammonia or an amine. The amines that can be used are known in the art and described, for example, in U.S. Pat. Nos. 3,275,554 and 3,438,757, both of which are incorporated herein by reference. These amines must possess at least one primary or secondary amino group.

Another group of amines suitable for use in this invention are branched polyalkylene polyamines. The branched polyalkylene polyamines are polyalkylene polyamines wherein the branched group is a side chain containing on the average at least one nitrogen-bonded aminoalkylene $$\text{(i.e., } NH_2-R-\overset{\overset{\displaystyle H}{|}}{N}-R_x-\text{)}$$

group per nine amino units present on the main chain; for example, 1–4 of such branched chains per nine units on the main chain, but preferably one side chain unit per nine main chain units. Thus, these polyamines contain at least three primary amino groups and at least one tertiary amino group. U.S. Pat. Nos. 3,200,106 and 3,259,578 are incorporated herein by reference for their disclosures relative to said polyamines.

Suitable amines also include polyoxyalkylene polyamines, e.g., polyoxyalkylene diamines and polyoxyalkylene triamines, having average molecular weights ranging from about 200 to about 4000, and in one embodiment from about 400 to 2000. Examples of these polyoxyalkylene polyamines include those amines represented by the formula:

$$NH_2\text{Alkylene}-(-O\text{-Alkylene-})_m NH_2$$

wherein m has a value of from about 3 to about 70, and in one embodiment from about 10 to about 35; and the formula:

$$R-[\text{Alkylene-}(-O\text{-Alkylene-})_n NH_2)_{3\text{-}6}$$

wherein n is a number in the range of from 1 to about 40, with the proviso that the sum of all of the n's is from about 3 to about 70 and generally from about 6 to about 35, and R is a polyvalent saturated hydrocarbyl group of up to about 10 carbon atoms having a valence of from about 3 to about 6. The alkylene groups may be straight or branched chains and contain from 1 to about 7 carbon atoms, and usually from 1 to about 4 carbon atoms. The various alkylene groups present within the above formulae may be the same or different.

Useful polyoxyalkylene polyamines include the polyoxyethylene and polyoxypropylene diamines and the polyoxypropylene triamines having average molecular weights ranging from about 200 to about 2000. The polyoxyalkylene polyamines are commercially available from the Jefferson Chemical Company, Inc. under the trade name "Jeffamine." U.S. Pat. Nos. 3,804,763 and 3,948,800 are incorporated herein by reference for their disclosure of such polyoxyalkylene polyamines.

Useful amines are the alkylene polyamines conforming to the formula:

$$H-\underset{\underset{\displaystyle R}{|}}{N}\text{-(Alkylene-}\underset{\underset{\displaystyle R}{|}}{N})_n R$$

wherein n is from 1 to about 10; each R is independently a hydrogen atom, a hydrocarbyl group or a hydroxy-substituted hydrocarbyl group having up to about 700 carbon atoms, and in one embodiment up to about 100 carbon atoms, and in one embodiment up to about 30 carbon atoms; and the "Alkylene" group has from about 1 to about 10 carbon atoms with the preferred alkylene being ethylene or propylene. Useful are the alkylene polyamines wherein each R is hydrogen with the ethylene polyamines, and mixtures of ethylene polyamines being particularly preferred. Usually n will have an average value of from about 2 to about 7. Such alkylene polyamines include methylene polyamines, ethylene polyamines, butylene polyamines, propylene polyamines, pentylene polyamines, hexylene polyamines, heptylene polyamines, etc. The higher homologs of such amines and related aminoalkyl-substituted piperazines are also included.

Alkylene polyamines that are useful include ethylene diamine, triethylene tetramine, propylene diamine, trimethylene diamine, hexamethylene diamine, decamethylene diamine, octamethylene diarnine, di(heptamethylene) triamine, tripropylene tetramine, tetraethylene pentamine, trimethylene diamine, pentaethylene hexamine, di(trimethylene) triamine, N-(2-aminoethyl) piperazine, 1,4-bis(2-amino ethyl) piperazine, and the like. Higher homologs as are obtained by condensing two or more of the above-illustrated alkylene amines are useful as amines in this invention as are mixtures of two or more of any of the aforedescribed polyamines.

Ethylene polyamines, such as those mentioned above, are described in detail under the heading "Diamines and Higher Amines" in The Encyclopedia of Chemical Technology, Second Edition, Kirk and Othmer, Volume 7, pages 27–39, Interscience Publishers, Division of John Wiley and Sons, 1965, these pages being incorporated herein by reference. Such compounds are prepared most conveniently by the reaction of an alkylene chloride with ammonia or by reaction of an ethylene imine with a ringopening reagent such as ammonia, etc. These reactions result in the production of the somewhat complex mixtures of alkylene polyamines, including cyclic condensation products such as piperazines.

A useful class of polyamines that can be used are those represented by the formula $$H-\underset{\underset{\displaystyle R}{|}}{N}-(Z-NR')_x-R$$

in which each R is hydrogen or a hydrocarbyl group; each R' is independently hydrogen, alkyl, or $NH_2R''(NR'')_y$— where each R" is independently an alkylene group of 1 to about 10 carbon atoms and y is a number in the range of from 1 to about 6; each Z is independently an alkylene group of 1 to about 10 carbon atoms, a heterocyclic nitrogen containing cycloalkylene or an oxyalkylene group of 1 to about 10 carbon atoms and x is a number in the range of from 1 to about 10.

Polyamine Bottoms Useful as Polyamines (A)(II)(b) or in Making Condensed Polyamines (A) (II) (c).

The polyamine bottoms that can be used as either the polyamines (A)(II)(b) or in making the condensed polyamines (A)(II)(c) are polyamine mixtures resulting from stripping of the alkylene polyamine mixtures discussed above. Lower molecular weight polyamines and volatile contaminates are removed from an alkylene polyamine mixture to leave as residue what is often termed "polyamine bottoms." In general, alkylene polyamine bottoms can be characterized as having less than 2%, usually less than 1% by weight material boiling below about 200° C. In the instance of ethylene polyamine bottoms, the bottoms contain less than about 2% by weight total diethylene triamine (DETA) or triethylene tetramine (TETA). A typical sample of such ethylene polyamine bottoms obtained from the Dow Chemical Company of Freeport, Texas designated "E-100" showed a specific gravity at 15.6° C. of 1.0168, a percent nitrogen by weight of 33.15 and a viscosity at 40° C. of 121 centistokes. Gas chromatography analysis of such a sample showed it to contain about 0.93% "Light Ends" (DETA), 0.72% TETA, 21.74% tetraethylene pentamine and 76.61% pentaethylene hexamine and higher (by weight). These alkylene polyamine bottoms include cyclic condensation products such as piperazine and higher analogs of diethylene triamine, triethylene tetramine and the like.

Process for Making the Condensed Polyamines (A)(II)(a) and (A)(II)(c).

The reaction between the hydroxy material and the amine to form the condensed polyamines (A)(II)(a) and (A)(II)(c) requires the presence of an acid catalyst. The catalysts that are useful include mineral acids (mono, di- and polybasic acids) such as sulfuric acid and phosphoric acid; organo phosphorus acids and organo sulfonic acids such as $RP(O)(OH)_2$ and $RSO_3H$, wherein R is hydrocarbyl; alkali metal partial salts of $H_3PO_4$ and $H_2SO_4$, such as $NaHSO_4$, $LiHSO_4$, $KHSO_4$, $NaH_2PO_4$, $LiH_2PO_4$ and $KH_2PO_4$; alkaline earth metal partial salts of $H_3PO_4$ and $H_2SO_4$, such as $CaHPO_4$, $CaSO_4$ and Mg $HPO_4$; also $Al_20_3$ and Zeolites. Phosphoric acid is useful because of its commercial availability and ease of handling. Also useful as catalysts for this invention are materials which generate acids when treated in the reaction mixture, e.g., triphenylphosphite.

The reaction is run at an elevated temperature which, depending upon the particular reactants, can range from about 60° C. to about 265° C. Most reactions, however, are run in the range of about 220° C. to about 250° C. The reaction may be run at atmospheric pressure or optionally at a reduced pressure depending upon the particular reactants. The degree of condensation of the resultant polyamine is limited only to the extent necessary to prevent the formation of solid products under reaction conditions. The control of the degree of condensation of the product is normally accomplished by limiting the amount of the condensing agent, i.e., the hydroxy material, charged to the reaction medium. In one embodiment, the condensed polyamines are pourable at room temperature and have viscosities which range from about 100% greater than the viscosity of the amine reactant to about 6000% greater than the viscosity of the amine reactant. In one embodiment, the condensed polyamines have viscosities which range from about 50% to about 1000% greater than the viscosity of the amine reactant. In one embodiment, the viscosity of the condensed polyamines ranges from about 50 cSt to about 200 cSt at 100° C.

Process for Making the Acylated Amine (A).

The carboxylic acid acylating agents (A)(I) can be reacted with the polyamines (A)(II) according to conventional amide, imide or amidene forming techniques to form the acylated amines (A). This normally involves heating the acylating agent (A) with the polyamine (A)(II), optionally in the presence of a normally liquid, substantially inert, organic liquid solvent/diluent. Temperatures of at least about 30° C. up to the decomposition temperature of the reaction component and/or product having the lowest such temperature can be used. This temperature usually is in the range of about 80° C. to about 250° C.

The relative proportions of the acylating agent (A)(I) and the polyamine (A)(II) to be used in the above process are such that at least about one-half of a stoichiometrically equivalent amount of the polyamine (A)(II) is used for each equivalent of the acylating agent (A)(I) used. In this regard it will be noted that the equivalent weight of the polyamine (A)(II) is based upon the number of the nitrogen-containing groups defined by the structural configuration

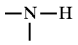

Similarly the equivalent weight of the acylating agent (A)(I) is based upon the number of the acid-producing groups defined by the structural configuration

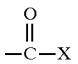

Thus, ethylene diamine has two equivalents per mole; amino guanidine has four equivalents per mole; a succinic acid or ester has two equivalents per mole, etc. The upper limit of the useful amount of the polyamine (A)(II) appears to be about two moles for each equivalent of the acylating agent (A)(I) used. Such amount is required, for instance, in the formation of products having predominantly amidine linkages. Beyond this limit, the excess amount of the polyamine (A)(II) appears not to take part in the reaction. On the other hand, the lower limit of about one-half equivalent of the polyamine (A)(II) used for each equivalent of the acylating agent (A)(I) is based upon the stoichiometry for the formation of products having predominantly imide linkages. In most instances, the amount of the polyamine (A)(II) is approximately one equivalent for each equivalent of the acylating agent (A)(I) used. In one embodiment, the acylated amines (A) are prepared in the same manner as the polyamines (A)(II) of the present invention. That is, they are prepared by the acid catalyzed condensation reaction of at least one carboxylic acylating agent (A)(I) with at least one polyamine (A)(II). The catalysts previously described with respect to the polyamines (A)(II) are useful in this reaction. The acylated amines (A) generally have a total base number (TBN) in the range of about 45 to about 90, and in one embodiment about 55 to about 80. The following examples are illustrative of the preparation of acylated amines (A) that are useful with this invention. In the following example, as well as throughout the specification and in the claims, unless otherwise indicated, all parts and percentages are by weight, all temperatures are in degrees Celsius, and all pressures are at or near atmospheric.

Example A-1

Part I

A mixture of 76.4 parts by weight of HPA-X (a product of Union Carbide identified as a polyamine bottoms product having a nitrogen content of 31.5% by weight and an average base number of 1180) and 46.7 parts by weight of THAM (trishydroxymethyl aminomethane) are heated at a temperature of 220° C. under condensation reaction conditions in the presence of 1.25 parts by weight of an 85% by weight phosphoric acid aqueous solution to form a condensed polyamine. 1.7 parts by weight a 50% aqueous solution of NaOH are then added to the reaction mixture to neutralize the phosphoric acid. The resulting product is a condensed polyamine having the following properties: viscosity at 40° C. of 6500 cSt; viscosity at 100° C. of 90 cSt; total base number of 730; and nitrogen content of 27% by weight.

Part II

A mixture of 1000 parts by weight of polyisobutenyl (Mn=1000) succinic anhydride and 400 parts by weight of diluent oil are charged to a reactor while mixing under a $N_2$ purge. The batch temperature is adjusted to 88° C. 152 parts by weight of the condensed polyamine from Part I are charged to the reactor while maintaining the reactor temperature at 88°–93° C. The molar ratio of acid to nitrogen is 1 COOH: 1.55N. The batch is mixed for two hours at 82°–96° C., then heated to 152° C. over 5.5 hours. The $N_2$ purge is discontinued and submerged $N_2$ blowing is begun. The batch is blown to a water content of 0.30% by weight or less at 149°–154° C., cooled to 138°–149° C. and filtered Diluent oil is added to provide an oil content of 40% by weight. The resulting product has a nitrogen content of 2.15% by weight, a viscosity at 100° C. of 210 cSt, and a total base number of 48.

Example A-2

A mixture of 108 parts by weight of a polyamine mixture (15% by weight diethylene triamine and 85% by weight polyamine bottoms) and 698 parts by weight diluent oil is charged to a reactor. 1000 parts by weight of polyisobutenyl ($\overline{Mn}$=1000) succinic anhydride are charged to the reactor under a N2 purge while maintaining the batch temperature at 110°–121° C. The molar ratio of acid to nitrogen is 1 COOH: 1.5N. After neutralization submerged $N_2$ blowing is begun. The batch is heated to 143°–149° C., and then filtered. Diluent oil is added to provide an oil content of 40% by weight. The resulting product has a nitrogen content of 2.0% by weight, a viscosity at 100° C. of 135–155 cSt, and a total base number of 55.

(B) Boron Compound.

The boron compound can be an inorganic or an organic compound. The inorganic compounds include the boron acids, anhydrides, oxides and halides. The organic boron compounds include the boron amides and esters. Also included are the borated acylated amines of (A) as well other borated acylated amines and borated dispersants, borated epoxides and the borated fatty acid esters of glycerol.

The boron compounds that are useful include boron oxide, boron oxide hydrate, boron trioxide, boron trifluoride, boron tribromide, boron trichloride, boron acids such as boronic acid (i.e., alkyl-$B(OH)_2$ or aryl-$B(OH)_2$), boric acid (i.e., $H_3BO_3$), tetraboric acid (i.e., $H_2B_40_7$), metaboric acid (i.e., $HBO_2$), boron anhydrides, boron amides and various esters of such boron acids. Complexes of boron trihalide with ethers, organic acids, inorganic acids, or hydrocarbons can be used. Examples of such complexes include boron-trifluoride-triethyl ester, boron trifluoride-phosphoric acid, boron trichloride-chloroacetic acid, boron tribromide-dioxane, and boron trifluoride methyl ethyl ether.

Specific examples of boronic acids include methyl boronic acid, phenyl-boronic acid, cyclohexyl boronic acid, p-heptylphenyl boronic acid and dodecyl boronic acid.

The boron acid esters include mono-, di-, and tri-organic esters of boric acid with alcohols or phenols such as, e.g., methanol, ethanol, isopropanol, cyclohexanol, cyclopentanol, 1-octanol, 2-octanol, dodecanol, behenyl alcohol, oleyl alcohol, stearyl alcohol, benzyl alcohol, 2-butyl cyclohexanol, ethylene glycol, propylene glycol, trimethylene glycol, 1,3-butanediol, 2,4-hexanediol, 1,2-cyclohexanediol, 1,3-octanediol, glycerol, pentaerythritol diethylene glycol, carbitol, Cellosolve, triethylene glycol, tripropylene glycol, phenol, naphthol, p-butylphenol, o,p-diheptyl phenol, n-cyclohexylphenol, 2,2-bis-(p-hydroxyphenyl)-propane, polyisobutene (molecular weight of 1500)-substituted phenol, ethylene chlorohydrin, o-chlorophenol, m-nitrophenol, 6-bromooctanol, and 7-keto-decanol. Lower alcohols, 1,2-glycols, and 1-3-glycols, i.e., those having less than about 8 carbon atoms are especially useful for preparing the boric acid esters for the purpose of this invention.

Methods for preparing the esters of boron acid are known and disclosed in the art (such as "Chemical Reviews," pp. 959–1064, Vol. 56). Thus, one method involves the reaction of boron trichloride with 3 moles of an alcohol or a phenol to result in a tri-organic borate. Another method involves the reaction of boric oxide with an alcohol or a phenol. Another method involves the direct esterification of tetra boric acid with 3 moles of an alcohol or a phenol. Still another method involves the direct esterification of boric acid with a glycol to form, e.g., a cyclic alkylene borate.

Borated Acylated Amines.

The borated acylated amines can be prepared by first reacting a carboxylic acid acylating agent with at least about one-half equivalent, per equivalent of carboxylic acid acylating agent, of an amine containing at least one hydrogen attached to a nitrogen group. The acylated amine obtained in this manner is usually a complex mixture of acylated amines. The acylated amine is then borated by reacting it with a boron compound of the type described above, including the boron trioxides, boron halides. boron acids, boron amides, and esters of boron acids.

The acylated amines that can be used are described above under the subtitle "(A) Acylated Amines". Additional acylated amines that can be used are described in the following U.S. patents:

| | | |
|---|---|---|
| 3,087,936 | 3,341,542 | 3,630,904 |
| 3,172,892 | 3,346,493 | 3,632,511 |
| 3,215,707 | 3,444,170 | 3,787,374 |
| 3,254,025 | 3,454,607 | 4,234,435 |
| 3,272,746 | 3,541,012 | |
| 3,316,177 | | |

The above U.S. patents are expressly incorporated herein by reference for their teaching of the preparation of acylated amines that are useful herein.

The amount of boron compound reacted with the acylated amine intermediate generally is sufficient to provide from about 0.1 atomic proportion of boron for each mole of the acylated amine up to about 10 atomic proportions of boron for each atomic proportion of nitrogen of said acylated amine. More generally the amount of boron compound present is sufficient to provide from about 0.5 atomic proportion of boron for each mole of the acylated amine to about 2 atomic proportions of boron for each atomic proportion of nitrogen used.

The reaction of the acylated amine with the boron compound can be effected simply by mixing the reactants at the desired temperature. The use of an inert solvent is optional although it is often desirable, especially when a highly viscous or solid reactant is present in the reaction mixture. The inert solvent may be a hydrocarbon such as benzene, toluene, naphtha, cyclohexane, n-hexane, or mineral oil. The temperature of the reaction may be varied within wide ranges. Ordinarily it is preferably between about 50° C. and about 250° C. In some instances it may be 25° C. or even lower. The upper limit of the temperature is the decomposition point of the particular reaction mixture and/or product.

The reaction is usually complete within a short period such as 0.5 to 6 hours. After the reaction is complete, the product may be dissolved in the solvent and the resulting solution purified by centrifugation or filtration if it appears to be hazy or contain insoluble substances. Ordinarily the product is sufficiently pure so that further purification is unnecessary or optional.

The above described dispersants may be post treated with such reagents as carbon disulfide to give a sulfurized dispersant. This reaction type is presented in U.S. Pat. No. 3,200,107 to LeSuer. An example of the preparation of a sulfurized succan dispersant is given below:

EXAMPLE 1

To a mixture of 1 750 grams of a mineral oil and 3500 grams (6.5 equivalents) of a polyisobutene-substituted succinic ankydride having an acid number of 104 prepared by the reaction of maleic anhydride with a chlorinated polyisobutene having a molecular weight of 1000 and a chlorine content of 4.5% there is added at 70° C.–100° G 946 grams (25.9 equivalents) of triethylene tetramine.

The reaction is exothermic. The mixture is heated at 160° C.–170° C.for 12 hours while nitrogen is passed through the mixture, whereupon 59 cc. of water is collected as the distillate. The mixture is diluted with 1165 grams of mineral oil and filtered The filtrate is found to have a nitrogen content of 4.12%. The 6000 grams of the above acylated product there is added 608 grams (16 equivalents) of carbon disulfide at 25°–50° C. throughout a period of 2 hours The mixture is heated at 60°–73° C. for 3 hours and then at 68°–85° C./7 mm. Hgfor 5.5 hours. The residue is filtered at 85° C. and the filtrate is found to have a nitrogen content of 4.45% and a sulfur content of 4.8%.

Dispersants can also be classified Mannich base dispersants. These are reaction products between alkylphenols in which the alkyl group contains at least about 30 carbon atoms with lower aliphatic aldehydes (especially formal dehydes) and amines. The preferred amines are polyalkylene polyamines. The dispersants are well known in the art and are described in U.S. Pat. Nos. 3,275,554, 3,454,555; 3,438,757 and 3,565,804 which are herein incorporated by reference for material to do with Mannich dispersants.

The base oils of lubricating viscosity of utility in this invention are natural oils from plants, animals and mineral lubricating oils such as liquid petroleum oils and solvent treated or acid treated mineral lubricating oils of the parafinic, naphtenic or mixed napthenic-parafinic types. Oils of lubricating viscosity from coal and shale are also useful.

The synthetic lubricating oils useful herein include hydrocarbon oils and halo-substituted hydrocarbon oils such as polymerized and interpolymerized olefins (e.g., polybutylenes, polypropylenes, propylene-isobutylene copolymers, chlorinated polybutylenes, etc.); poly(1-hexenes), poly(1-octenes), poly(1-decenes), etc. and mixtures thereof, alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl esters and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methyl polyisopropylene glycol ether having an average molecular weight of about 1000, diphenyl ether of polyethylene glycol having a molecular weight of about 500–1000, diphenyl ether of polypropylene glycol having a molecular weight of about 1000–1500, etc.) or mono- and polycarboxylic esters thereof, for example, the acetic acid esters, mixed $C_3$–$C_8$ fatty acid esters, or the $C_{13}$0xo acid diester of tetraethylene glycol.

Another suitable class of synthetic lubricating, oils that can be used comprises the esters of dicraboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl)-sebacate, di-n-hexyl fumarate, dioctyl sebacate, diisooctyl azelate, diisodecylazelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycl, trimethylol propane, pentaerythritol, dipentaerythriotol, tripentaerythriotol, etc.

Silicon-based oils such as the plyalkyl-, polyaryl-polyalkoxy- or polyaryloxy silane oils and silicate oils comprise another useful class of synthetic lubricants (e.g., tetraethyl silicate, tetraisopropyl silicate, tetra-(2-ethylhexyl)silicate, tetra-(4-methyl hexyl)silicate, tetra-(p-tert-butylphenyl)silicate, hexyl(4-methyl-2-pentoxy)-disiloxane, poly(methyl)siloxanes, poly(methylphenyl)-siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Polyolefin oligomers are typically formed by the polymerization reaction of alpha-olefins. Nonalpha-olefins may be oligomerized to give a synthetic oil within the present invention, however, the reactivity and availability of alpha-olefins at low cost dictates their selection as the source of the oligomer.

The polyolefin oligomer synthetic lubricating oils of interest in the present invention include hydrocarbon oils and halo-substituted hydrocarbon oils such as are obtained as the polymerized and interpolymerized olefins, e.g., oligomers, include the polybutylenes, polypropylenes, propylene-isobutylene copolymers, chlorinated polybutylenes, poly(1-hexenes), poly(1-octenes), poly(1-decenes), similar materials and mixtures thereof Typically, the oligomer is obtained from a monomer containing from about 6 to 18 carbon atoms, preferably from about 8 carbon atoms to about 12 carbon atoms. Most preferably, the monomer used to form the oligomer is decene, and preferably 1-decene. The nomenclature alpha-olefin is a trivial name and the IUPAC nomenclature of a 1-ene compound may be considered to have the same meaning within the present invention.

While it is not essential that the oligomer be formed from an alpha-olefin, such is desirable. The reason for forming the oligomer from an alpha-olefin is that branching will naturally occur at the points where the olefin monomers are joined together and any additional branching within the backbone of the olefin can provide too high a viscosity of the end oil. It is also desirable that the polymer formed from the alpha olefin be hydrogenated. The hydrogenation is conducted according to known practices. By hydrogenating the polymer free radial attack on the allyic carbons remaining after polymerication is minimized.

The molecular weight of the oligomer is typically averages from about 250 to about 1400, conveniently from about 280 to about 1200 preferably from about 300 to about 1100 and most preferably about 340 to about 520. The choice of molecular weight of the oligomer is largely dependent upon whether a viscosity improver is included within the formulation. That is, the polyolefin oligomer, may require either a thickening or a thinning effect to ensure that the proper lubricating viscosities are maintained under extreme heat and cold conditions.

The table below gives examples of preferred compositions of blended ATF's containing the present invention. Percents given are in weight percent of each component based on weight of the ATF's. The blended ATF usually comprises roughly about 80 percent by weight oil of lubricating viscosity and 20 percent by weight additive package.

| Component | Ranges |
|---|---|
| Oil of Lubricating Viscosity | Majority 45–90% |
| Alkoxylated fatty amines | 0.05–8% |
| Other friction modifiers, each | 0.01–4% |
| Antioxidants | up to 12% |
| Overbased metal organic acid | up to 20% |
| Dispersants | up to 20% |
| Viscosity Index Improver and/or dispersant-viscosity modifier | up to 40% |
| Extreme Pressure Agent | up to 5% |
| Seal Swell | up to 5% |
| 85% phosphoric acid | up to 3% |

What is claimed is:

1. A composition for use as a lubricant additive, said composition comprising:

(A) A calcium salt of an overbased sulfonic acid having TBN of 20–300;

(B) at least about 0.05 weight percent phosphoric acid;

(C) three friction modifiers, wherein said friction modifiers comprise an alkoxylated fatty amine and two others selected from:
borated fatty epoxides
fatty phosphites
fatty epoxides
fatty amines
borated alkoxylated fatty amrines
metal salts of fatty acids
fatty acid amides
glycerol esters
borated glycerol esters or
fatty imidazolines;

(D) disubstituted hydrogen phosphite antiwear agents or mixtures thereof;

(E) a polymethacrylate dispersant viscosity modifier or maleic anhydride/styrene co-polymer viscosity modifier.

2. A composition according to claim 1 wherein said friction modifiers farther comprise an alkoxylated fatty amine, a borated fatty epoxide and one other selected from the list in claim 1.

3. The composition of claim 1 as minority components in lubricants and functional fluids.

4. The composition of claim 3, wherein said functional fluid is an automatic transmission fluid.

5. A composition for use as a lubricant additive, said composition comprising:

(A) an overbased metal salt;

(B) at least about 0.05 weight percent of a phosphorus acid, phosphorus acid salt, phosphorus acid ester, phosphite phosphorus-containing amide, phosphorus-containing carboxylic acid, phosphorus-containing carboxylic ester, phosphorus-containing ether, or mixtures thereof;

(C) three friction modifiers comprising an alkoxylated fatty amine, a borated fatty epoxide and a fatty acid ester of glycerol;

(D) an antiwear agent;

(E) a viscosity modifier.

* * * * *

UNITED STATES PATENT AND TRADEMARK OFFICE

CERTIFICATE OF CORRECTION

PATENT NO. : 5,858,929
DATED : January 12, 1999
INVENTOR(S) : James L. Sumiejski, William C. Ward, Mitsuo Higashi, Craig D. Tipton

It is certified that error appears in the above-identified patent and that said Letters Patent is hereby corrected as shown below:

In column 36, lines 33 and 34, delete the word "phosphite."

Signed and Sealed this

Third Day of August, 1999

*Attest:*

*Attesting Officer*

Q. TODD DICKINSON

*Acting Commissioner of Patents and Trademarks*